US009790675B2

(12) United States Patent
Chen et al.

(10) Patent No.: US 9,790,675 B2
(45) Date of Patent: Oct. 17, 2017

(54) DOUBLE FLOW CONTROL MECHANISM OF A SOFT TOUCH DRAIN VALVE AND A DOUBLE FLOW CONTROL METHOD THEREOF

(71) Applicant: XIAMEN R&T PLUMBING TECHNOLOGY CO., LTD., Xiamen (CN)

(72) Inventors: Haibin Chen, Xiamen (CN); Rongyu Zhang, Xiamen (CN); Zhijun Zhong, Xiamen (CN); Ruiliang Chen, Xiamen (CN)

(73) Assignee: XIAMEN R&T PLUMBING TECHNOLOGY CO., LTD., Xiamen (CN)

( * ) Notice: Subject to any disclaimer, the term of this patent is extended or adjusted under 35 U.S.C. 154(b) by 50 days.

(21) Appl. No.: 14/945,044

(22) Filed: Nov. 18, 2015

(65) Prior Publication Data

US 2016/0154409 A1 Jun. 2, 2016

(30) Foreign Application Priority Data

Nov. 28, 2014 (CN) ..... 2014 1 0708611

(51) Int. Cl.
*E03D 1/14* (2006.01)
*E03D 1/30* (2006.01)

(52) U.S. Cl.
CPC ..... *E03D 1/302* (2013.01)

(58) Field of Classification Search
CPC ..... E03D 1/142
USPC ..... 4/300–442
See application file for complete search history.

(56) References Cited

U.S. PATENT DOCUMENTS 7,028,347 B2 * 4/2006 Sanderson ..... E03D 1/00 4/313
7,062,801 B2 * 6/2006 Oliver ..... E03D 1/142 4/325
8,918,922 B2 * 12/2014 Kido ..... E03D 1/35 4/324
9,476,192 B2 * 10/2016 Liu ..... E03D 1/144
(Continued)

FOREIGN PATENT DOCUMENTS

CN 2421343 Y 2/2001
CN 203729402 U 7/2014

OTHER PUBLICATIONS

China Patent Office, Office Action dated Sep. 6, 2015.

*Primary Examiner* — Lori Baker
(74) *Attorney, Agent, or Firm* — Rabin & Berdo, P.C.

(57) ABSTRACT

A double flow control mechanism of a soft touch drain valve and a double flow control method, includes a base, a float component and a starting component. The base is assembled with a valve body. The float component is has a flowing passage and can move relative to the base to open and close the drainage opening. The flowing passage connects the inside and the outside of the float chamber of the float component. The starting component controls the size of the flowing passage. The first starting switch can open a smaller flowing passage of the float component; the resultant force drains a first drainage volume of water. The second starting switch can open a larger flowing passage of the float component; the resultant force drains a second drainage volume of water.

30 Claims, 27 Drawing Sheets

(56) References Cited

U.S. PATENT DOCUMENTS

2011/0094022 A1* 4/2011 Li ..... E03D 1/142
4/324

* cited by examiner

DOUBLE FLOW CONTROL MECHANISM OF A SOFT TOUCH DRAIN VALVE AND A DOUBLE FLOW CONTROL METHOD THEREOF

FIELD OF THE INVENTION

The present invention relates to a double flow control mechanism of a soft touch drain valve and a double flow control method thereof.

BACKGROUND OF THE INVENTION

Existing are some soft touch drain valves, for example a double chain type double flow drain valve in the Chinese patent database with announcement number CN203684356U, which is provided to respectively adjust the high and low volume of the flushing water by two barrels vertically arranged, the upper barrel is a float, the bottom barrel is a float when the drain valve doesn't flush water and when the drain valve drains high volume of water, and it refills water when the drain valve drains low volume of water, this kind of technical proposal has unstable drainage volume, and it needs to close two sealing pad when in high and low drainage volume, it is easy to leak, and it is of bad application and complicated to operate.

SUMMARY OF THE INVENTION

The present invention is provided with a double flow control mechanism of a soft touch drain valve, which overcomes the disadvantages of the existing known technology. The technical proposal of the present invention is that: a double flow control mechanism of a soft touch drain vale, comprising a base (10), a float component and a starting component, the base (10) is assembled with a valve body (20), the base (10) is disposed with a drainage opening (11), the float component can move with relative to the base (10) to open and close the drainage opening (11), wherein;

the starting component comprises a first starting switch and a second starting switch, the float component is movably assembled to the valve body (20) and connected to the starting component in driving way, the float component is disposed with a flowing passage, the flowing passage connects the inner side and the outer side of a float chamber (112, 152) of the float component, the starting component controls the size of the flowing passage;

operating the first starting switch can drive the float component to rise up, the starting component opens a smaller flowing passage, the resultant force of the float component is influenced by the smaller flowing passage so as to drain a first drainage volume of water; operating the second starting switch can drive the float component to rise up, the starting component opens a larger flowing passage, the resultant force of the float component is influenced by the larger flowing passage so as to drain a second drainage volume of water.

In another preferred embodiment, the starting component comprises a switch element and a control element, the switch element is connected to the first starting switch and the second starting switch in driving way, the switch element is coupled to the control element in driving way, the control element is coupled to the flow passage, operating the first starting switch or the second starting switch can drive the control element by the switch element to control the size of the flowing passage or the on-off of the flowing passage.

In another preferred embodiment, the first starting switch comprises a first button (21) and the second starting switch comprises a second button (22), the first button (21) and the second button (22) are movably assembled to the valve body (20), the switch element is a slide block (310, 330, 340), the slide block (310, 330, 340) is laterally slidably assembled to the valve body (20) and connects to the first button (21) and the second button (22) in driving way, the slide block (310, 330, 340) is disposed with a pressing block (311, 331, 341, 342), the control element is disposed with a pressed block (220, 242, 261, 271, 281), the pressing block (311, 331, 341, 342) separates from the pressed block (220, 242, 261, 271, 281) or abuts against the pressed block (220, 242, 261, 271, 281) to implement the driving fit between the switch element and the control element.

In another preferred embodiment, the first starting switch comprises a first button (21) and the second starting switch comprises a second button (22), the first button (21) and the second button (22) are movably assembled to the valve body (20), the switch element is a pendulum rod (320) rotatably connected to the valve body (20), the pendulum rod (320) has a first pendulum block (321) and a second pendulum block (322), the first pendulum block (321) is coupled to the button in driving way, the second pendulum block (322) separates from the control element or abuts against the control element to implement the driving fit between the switch element and the control element.

In another preferred embodiment, the float component comprises a float (110) and a bottom plate (120) connected to the bottom portion of the float (110), the float chamber (112) is formed between the bottom plate (120) and the float (110), the bottom plate (120) is disposed with an inlet hole connecting the float chamber (112) and the drainage opening (11), operating the first starting switch can open the inlet hole smaller to form the smaller flowing passage, water enters the float (110) through the smaller flowing passage to drain a first drainage volume of water, operating the second starting switch can open the inlet hole larger to form the larger flowing passage, water enters the float (110) through the larger flowing passage to drain a second drainage volume of water.

In another preferred embodiment, the float component comprises a float (110) and a bottom plate (120) connected to the bottom portion of the float (110), the float chamber (112) is formed between the bottom plate (120) and the float (110), the bottom plate (120) is disposed with a first inlet hole (121) and a second inlet hole (122) that can connect the float chamber (112) and the drainage opening (11), the first inlet hole (121) forms the smaller flowing passage, the second inlet hole (122) forms the larger flowing passage, or in another case, the first inlet hole (121) and the second inlet hole (121) jointly form the larger flowing passage, when operating the first starting switch, water enters the float (110) through the smaller flowing passage formed by the first inlet hole (121) to drain a first drainage volume of water, when operating the second starting switch, water enters the float (110) through the larger flowing passage formed by the second inlet hole (122) or the larger flowing passage formed jointly by the first and the second inlet hole to drain a second drainage volume of water.

In another preferred embodiment, the float component comprises a float (110) and a bottom plate (120) connected to the bottom portion of the float (110), the float chamber (112) is formed between the bottom plate (120) and the float (110), the bottom plate (120) is disposed with a first inlet hole (121) and a second inlet hole (122) that can connect the float chamber (112) and the drainage opening (11), the first inlet hole (121) forms the smaller flowing passage, the second inlet hole (122) forms the larger flowing passage, or in another case, the first inlet hole (121) and the second inlet hole (121) jointly form the larger flowing passage, when operating the first starting switch, water enters the float (110) through the smaller flowing passage formed by the first inlet hole (121) to drain a first drainage volume of water, when operating the second starting switch, water enters the float (110) through the larger flowing passage formed by the second inlet hole (122) or the larger flowing passage formed jointly by the first and the second inlet hole to drain a second drainage volume of water.

In another preferred embodiment, the control element comprises a first check valve assembled to the first inlet hole (121) and a second check valve assembled to the second inlet hole (122), when the switch element separates from the second check valve, the switch element abuts against the first check valve to open the first inlet hole (121) and close the second inlet hole (122), when the switch element separates from the first check valve, the switch element abuts against the second check valve to open the second inlet hole (122) and close the first inlet hole (121).

In another preferred embodiment, the control element is assembled inside the float (110), the control element comprises a control board (210), the control board (210) is disposed with a first transition hole (211) that can be connected to the first inlet hole (121), when the switch element separates from the control element, the control board (210) is contacted with the bottom plate (120) so as to close the second inlet hole (122), and the first inlet hole (121) is connected to the first transition hole (211) to keep the first inlet hole (121) in open state, when the switch element abuts against the control element, the control board (210) separates from the bottom plate (120) so as to open the second inlet hole (122).

In another preferred embodiment, a first adjusting piece (130) and a second adjusting piece are further disposed and rotatable with relative to the bottom plate (120), the first adjusting piece (130) is disposed with a first adjusting hole (131) used to adjusting the size of the first inlet hole (121), the second adjusting piece (140) is disposed with a second adjusting hole (141) used to adjusting the size of the second inlet hole (122).

In another preferred embodiment, the float component comprises a float (150) and a separating plate (151) assembled inside the float (150), the float chamber (152) is formed between the float (150) and the separating plate (151), the float chamber (152) is connected to the drainage opening (11), the separating plate (151) is disposed with an exhaust pipe/hole connecting the float (152) and the outer air, when operating the first starting switch, the exhaust pipe/hole is open smaller to form the smaller flowing passage, water enters the float chamber (152) to exhaust the air in the float chamber (152) out of the smaller flowing passage so as to drain a first drainage volume of water, when operating the second starting switch, the exhaust pipe/hole is open larger to form the larger flowing passage, water enters the float chamber (152) to exhaust the air in the float chamber (152) out of the larger flowing passage so as to drain a second drainage volume of water.

In another preferred embodiment, the float component comprises a float (150) and a separating plate (151) assembled inside the float (150), the float chamber (152) is formed between the float (150) and the separating plate (151), the float chamber (152) is connected to the drainage opening (11), the separating plate (151) is disposed with a first exhaust pipe/hole and a second exhaust pipe/hole connecting the float (152) and the outer air, the first exhaust pipe/hole forms the smaller flowing passage, the second exhaust pipe/hole forms the larger flowing passage, or in another case, the first exhaust pipe/hole and the second exhaust pipe/hole jointly form the larger flowing passage, when operating the first starting switch, water enters the float chamber (152) to exhaust the air in the float chamber (152) out of the smaller flowing passage formed by the first exhaust pipe/hole so as to drain a first drainage volume of water, when operating the second starting switch, water enters the float chamber (152) to exhaust the air in the float chamber (152) out of the larger flowing passage formed by the second exhaust pipe/hole or the larger flowing passage formed jointly by the first and the second exhaust pipe/hole so as to drain a second drainage volume of water.

In another preferred embodiment, the float component comprises a float (150) and a separating plate (151) assembled inside the float (150), the float chamber (152) is formed between the float (150) and the separating plate (151), the float chamber (152) is connected to the drainage opening (11), the separating plate (151) is disposed with a first exhaust pipe/hole and a second exhaust pipe/hole connecting the float (152) and the outer air, the first exhaust pipe/hole forms the smaller flowing passage, the second exhaust pipe/hole forms the larger flowing passage, or in another case, the first exhaust pipe/hole and the second exhaust pipe/hole jointly form the larger flowing passage, when operating the first starting switch, water enters the float chamber (152) to exhaust the air in the float chamber (152) out of the smaller flowing passage formed by the first exhaust pipe/hole so as to drain a first drainage volume of water, when operating the second starting switch, water enters the float chamber (152) to exhaust the air in the float chamber (152) out of the larger flowing passage formed by the second exhaust pipe/hole or the larger flowing passage formed jointly by the first and the second exhaust pipe/hole so as to drain a second drainage volume of water.

In another preferred embodiment, the control element comprises a first check valve (260) assembled to the first exhaust pipe/hole and a second check valve (270) assembled to the second exhaust pipe/hole, when the switch element separates from the second check valve (270), the switch element abuts against the first check valve (260) to open the first exhaust pipe/hole and close the second exhaust pipe/hole, when the switch element separates from the first check valve (260), the switch element abuts against the second check valve (270) to open the second exhaust pipe/hole and close the first exhaust pipe/hole.

In another preferred embodiment, the first exhaust pipe (163) forms the smaller flowing passage, the first exhaust pipe (153) and the second exhaust pipe (154) jointly form the larger flowing passage, the control element is assembled to the third check valve (230) assembled inside the second exhaust pipe (154), the first exhaust pipe (153) keeps open, when the switch element separates from the control element, the third check valve (230) closes the second exhaust pipe (154), when the switch element abuts against the control element, the third check valve (230) opens the second exhaust pipe (154).

In another preferred embodiment, the first exhaust pipe (153) and the second exhaust pipe (154) are vertically movably assembled to the separating plate (151) to adjust the height of the bottom end of the first exhaust pipe (153) and the second exhaust pipe (154) in the float chamber (152); or in other case, the first exhaust pipe (153) and the second exhaust pipe (154) are fixedly assembled to the separating plate (151), a first adjusting sleeve pipe (155) and a second adjusting sleeve pipe (154) are further configured that the first adjusting sleeve pipe (155) is movably sleeved on the lower portion of the first exhaust pipe (153) to adjust the height of the bottom end of the first adjusting sleeve pipe (155) in the float chamber (152) and the second adjusting sleeve pipe (156) is movably sleeved on the lower portion of the second exhaust pipe (154) to adjust the height of the bottom end of the second adjusting sleeve pipe (156) in the float chamber (152).

In another preferred embodiment, the first exhaust hole (157) forms the smaller flowing passage, the first exhaust hole (157) and the second exhaust hole (158) jointly form the larger flowing passage, the control element is movable assembled inside the float chamber (152), the control element comprises a control board (240), the control board (240) is disposed with a second transition hole (241) connected to the first exhaust hole (157), when the switch element separates from the control element, the control board (240) is contacted with the separating plate (151) to close the second exhaust hole (158) and the first exhaust hole (157) is connected to the second transition hole (241) to keep the first exhaust hole (157) in open state, when the switch element abuts against the control element, the control board (240) separates from the separating plate (151) to open the second exhaust hole (158).

In another preferred embodiment, a first adjusting rod (251) and second adjusting rod (252) are movably assembled to the float component, the top end of the first adjusting rod (251) is disposed with a first adjusting portion (253), the top end of the second adjusting rod (252) is disposed with a second adjusting portion (254), the first adjusting portion (253) can adjust the size of the first exhaust hole, the second adjusting portion can adjust the size of the second exhaust hole (158).

In another preferred embodiment, the float component comprises a hollow float (110, 150) extending along the longitudinal axis, the hollow float (110, 150) is sleeved on the valve body (20) to move forth and back vertically along the valve body (20).

In another preferred embodiment, the valve body (20) is disposed with a guiding rod (23), the guiding rod (23) is fixedly assembled to the base (10), the hollow float (110, 150) is sleeved on the outer side of the guiding bar (23) to move forth and back vertically along the guiding rod (23).

In another preferred embodiment, the valve body (20) is disposed with a housing (28), the housing (28) is fixedly assembled to the base (10), the hollow float (110, 150) is sleeved inside the housing (28) to move forth and back vertically along the housing (28).

In another preferred embodiment, the starting component further comprises at least a lift rod (24, 25), the lift rod (24, 25) is movably assembled to the valve body and is connected to the float component in driving way, operating the first starting switch or the second starting switch can make the lift rod (24, 25) swing to life the float component to drain water.

Another technical proposal of the present invention is that: A double flow control method of a soft touch drain valve, wherein when operating a first starting switch, a starting component drives a float component to rise up to leave from a drainage opening of a base so as to drain water, at the same time, the starting component opens a smaller flowing passage in the float component, the resultant force of the float component is influenced by the smaller flowing passage so as to drain a first drainage volume of water; operating a second starting switch can drive the float component to rise up to leave from the drainage opening of the base so as to drain water, at the same time, the starting component opens a larger flowing passage in the float component, the resultant force of the float component is influenced by the larger flowing passage so as to drain a second drainage volume of water Compared to the existing known technology, the technical proposal of the present invention has advantages as follows:

1. The float component is disposed with the flowing passage, the flowing passage connects the inner and the outer of the float chamber of the float component, the starting component controls the size of the flowing passage, operating the first starting switch can open a smaller flowing passage of the float component, the resultant force of the float component is influenced by the smaller flowing passage to drain a first drainage volume of water; operating the second starting switch can open a larger flowing passage of the float component, the resultant force of the float component is influenced by the larger following passage to drain a second drainage volume of water. The soft touch drain valve can not only have double flow, but also have simple structure, strong applicability and stable drainage.

2. The float component comprises the float and the bottom plate assembled to the bottom portion of the float, the float chamber is formed between the bottom plate and the float, the bottom plate is disposed with inlet hole connecting the float chamber and the drainage opening, the inlet hole is the flowing passage, the inlet hole can be disposed more than one, the size of the flowing passage is controlled by the size of the inlet hole or the on-off of the inlet hole. When the flowing passage opens smaller, the float is lifted up to drain water, water enters the float chamber slowly, the float drops down slowly to realize high drainage volume, the first drainage volume; when the flowing passage opens larger, the float is lifted to drain water, water enters the float chamber quickly, the float drops down quickly to realize low drainage volume, the second drainage volume; the double flow principle is simple, the structure is simple and compact, the drainage is stable with high applicability.

3. The float component comprises the float and the separating plate assembled inside the float, the float chamber is formed between the float and the separating plate, the float chamber is connected to the drainage opening, the separating plate is disposed with exhaust pipe/hole connecting the float chamber and the outer air, the exhaust pipe/hole is the flowing passage, it can dispose with more than one exhausting pipe/hole, the size of the flowing passage is controlled by the open size of the exhaust pipe/hole or the on-off of the exhaust pipe/hole. When the flowing passage opens smaller, the float is lifted up to drain water, water enters the float chamber to exhaust air out of the float chamber slowly, the resultant force of the float component is larger, the float drops down slowly to realize high drainage volume, the first drainage volume; when the flowing passage opens larger, the float is lifted to drain water, water enters the float chamber to exhaust air out of the float chamber quickly, the resultant force of the float component is smaller, the float drops down quickly to realize low drainage volume, the second drainage volume; the double flow principle is simple, the structure is simple and compact, the drainage is stable with high applicability.

4. The starting component is disposed with the switch element and the control element that are coupled in driving way, the switch element is connected to the first and the second starting switch in driving way, the control element is coupled to the flowing passage, with the switch element and the control element, the first and the second starting switch can control the size of the flowing passage, it has simple control structure and strong reliability.

5. The size of the flowing passage is adjusted by the adjusting piece, adjusting sleeve pipe or the adjusting rod, so that the first drainage volume and the second drainage volume are respectively adjustable, it is convenient for different user's needs, the adjusting is convenient, the structure is simple and the function is reliable.

DETAILED DESCRIPTION OF THE DRAWINGS

The present invention will be further described with the drawings and the embodiments.

DETAILED DESCRIPTION OF THE EMBODIMENTS

The First Embodiment

Figure 1:
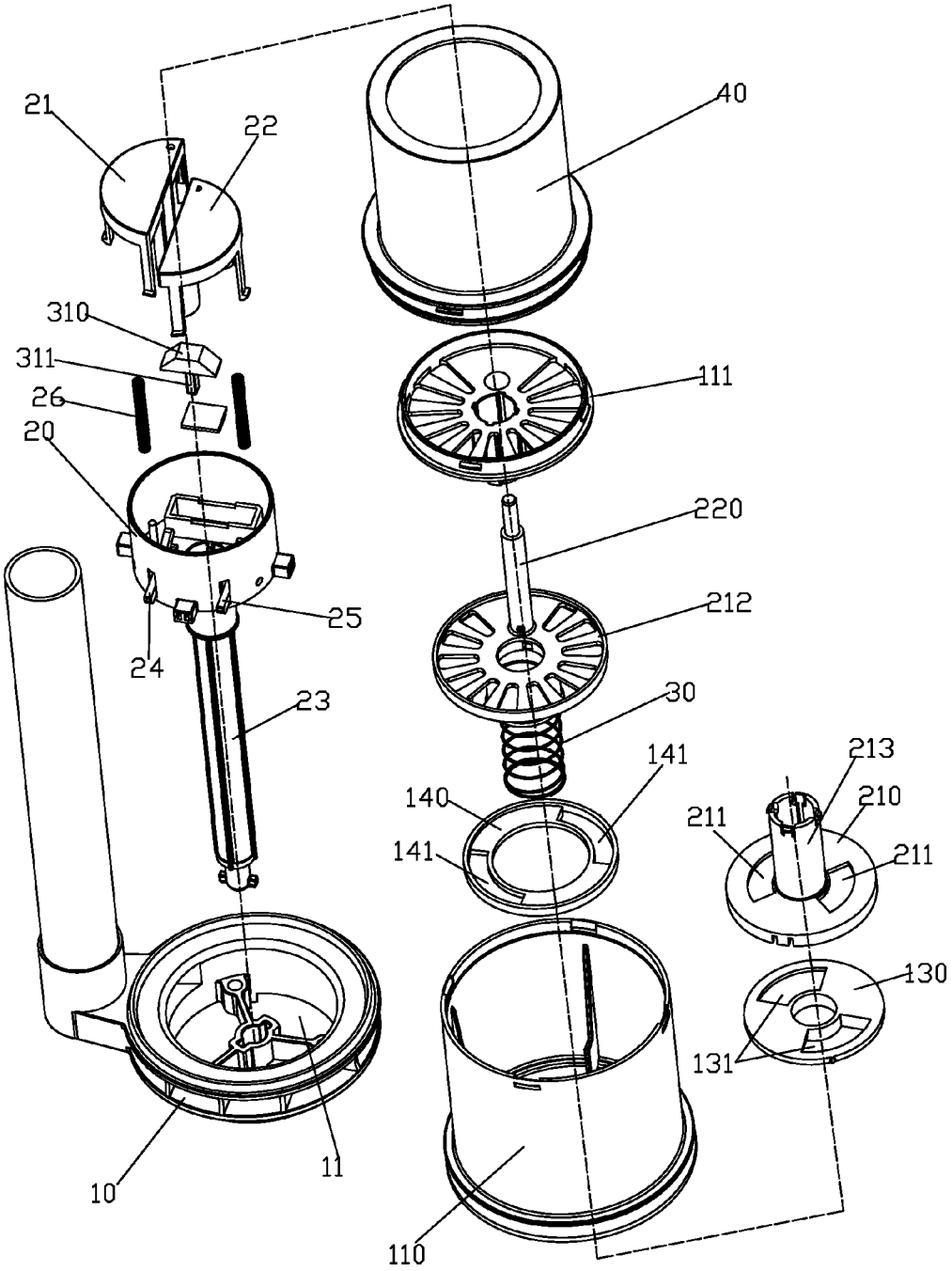
FIG. 1 illustrates an exploded and schematic of a double flow control mechanism of a soft touch drain valve of a first embodiment of the present invention.
Figure 2:
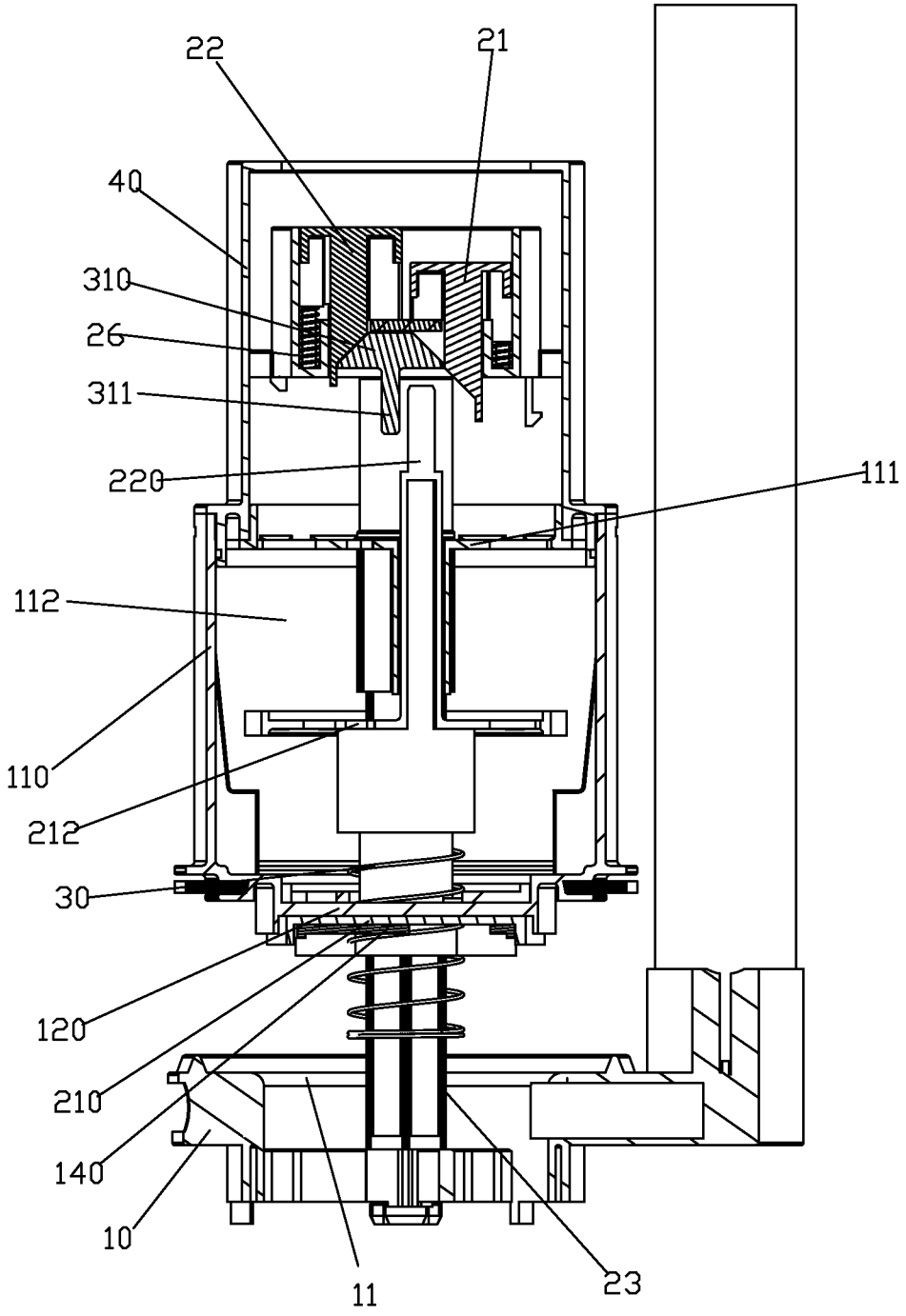
FIG. 2 illustrates a schematic diagram of the first embodiment in a first drainage volume.
Figure 3:
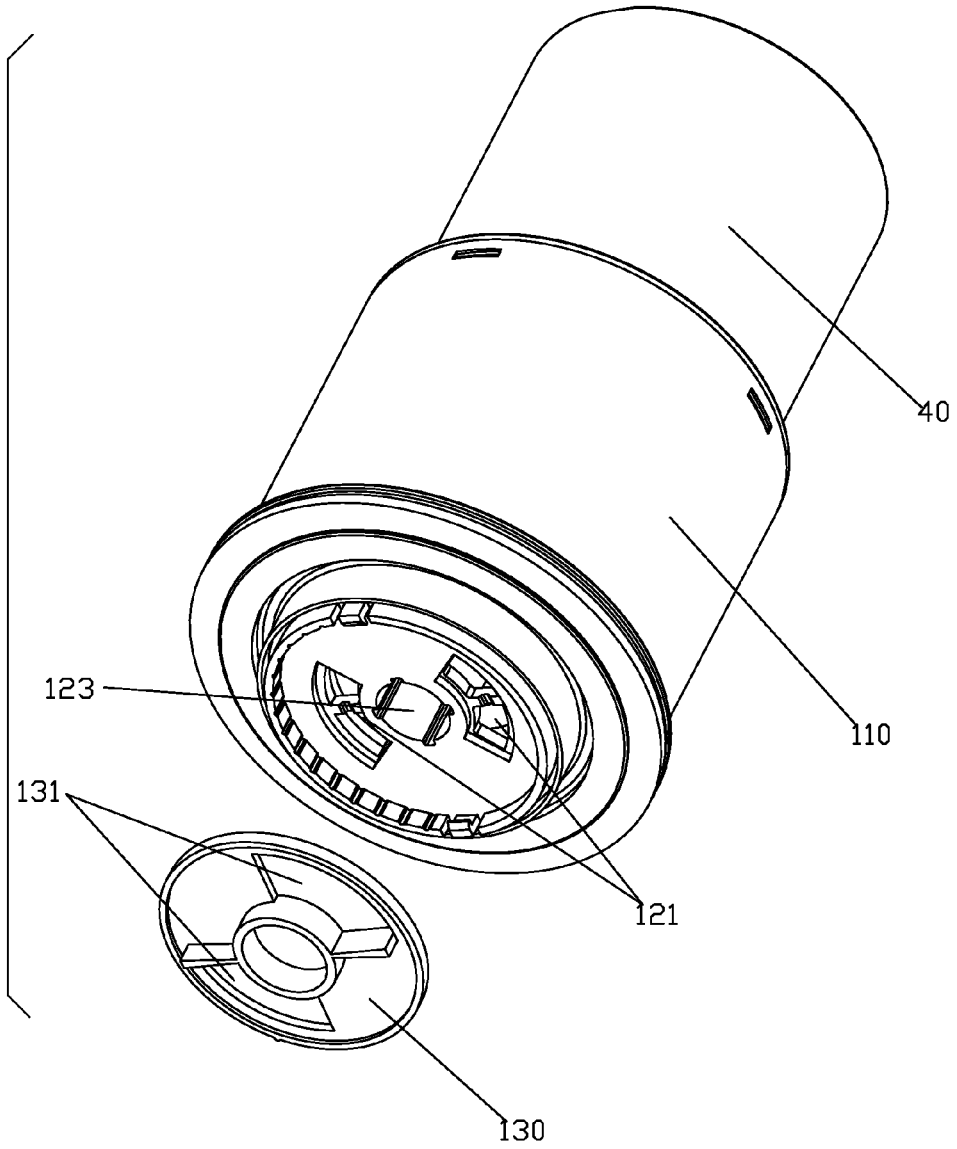
FIG. 3 illustrates a first schematic diagram of the float component of the first embodiment.
Figure 4:
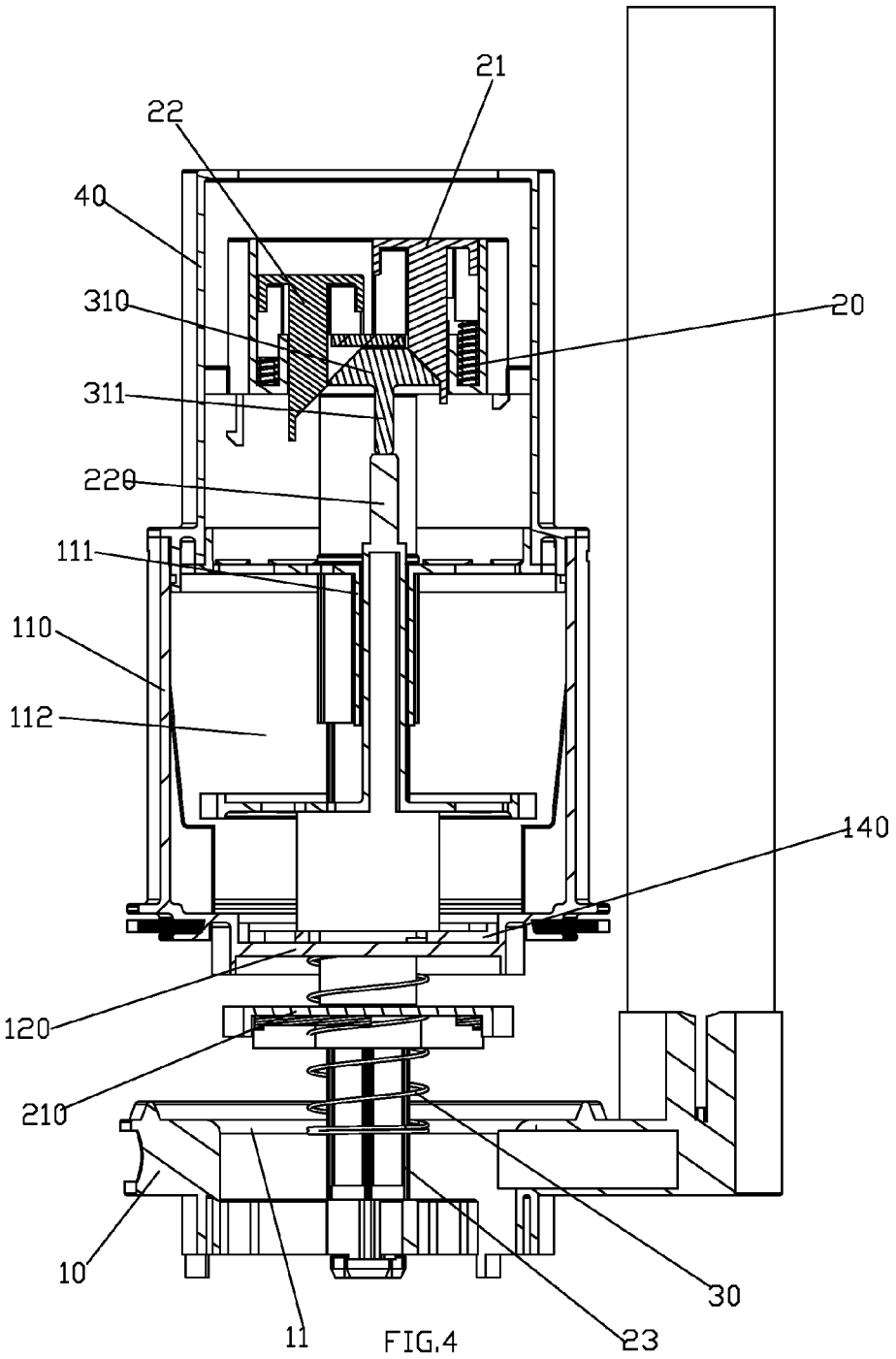
FIG. 4 illustrates a schematic diagram of the first embodiment in a second drainage volume.
Figure 5:
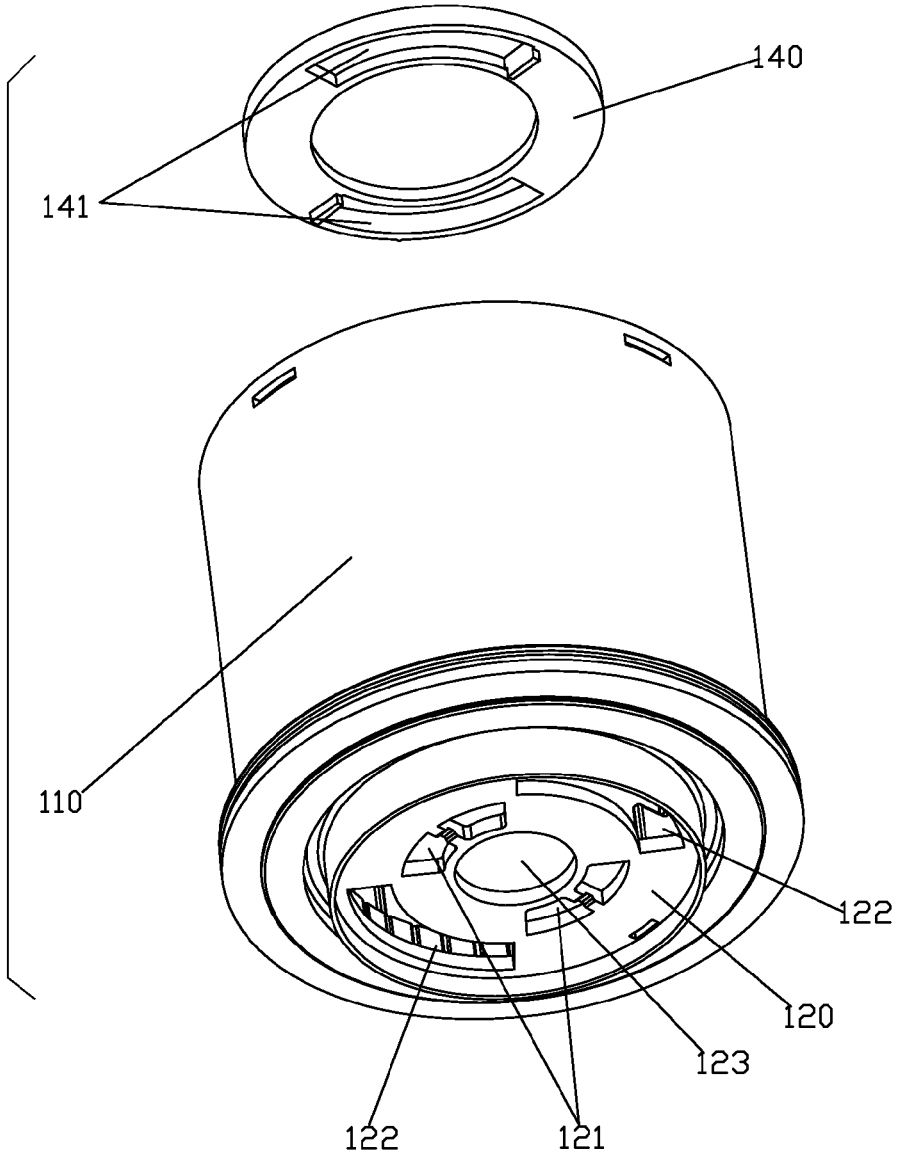
FIG. 5 illustrates a second schematic diagram of float component of the first embodiment.
Figure 6:
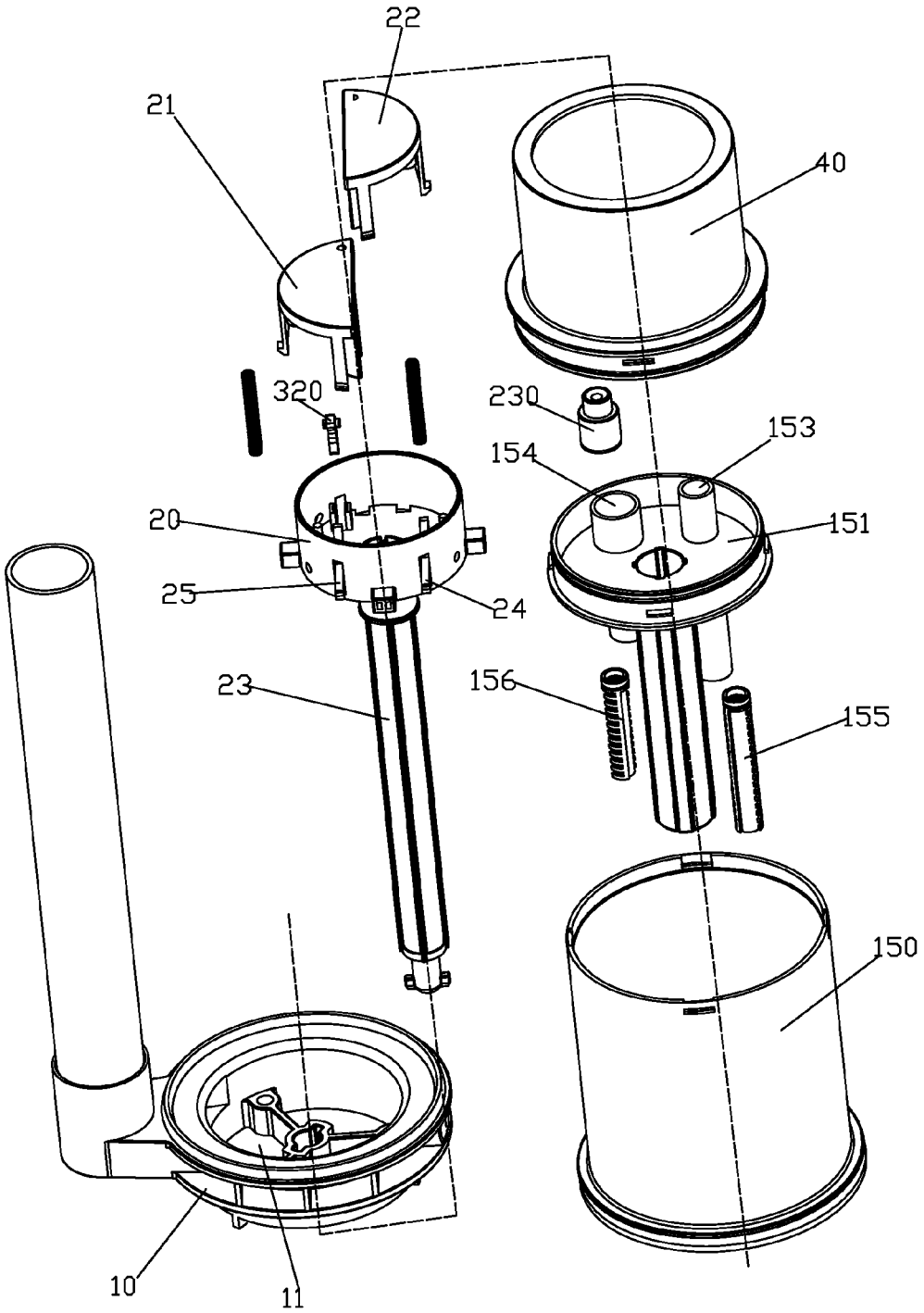
FIG. 6 illustrates an exploded and schematic diagram of a double flow control mechanism of a soft touch drain valve of a second embodiment of the present invention.
Figure 7:
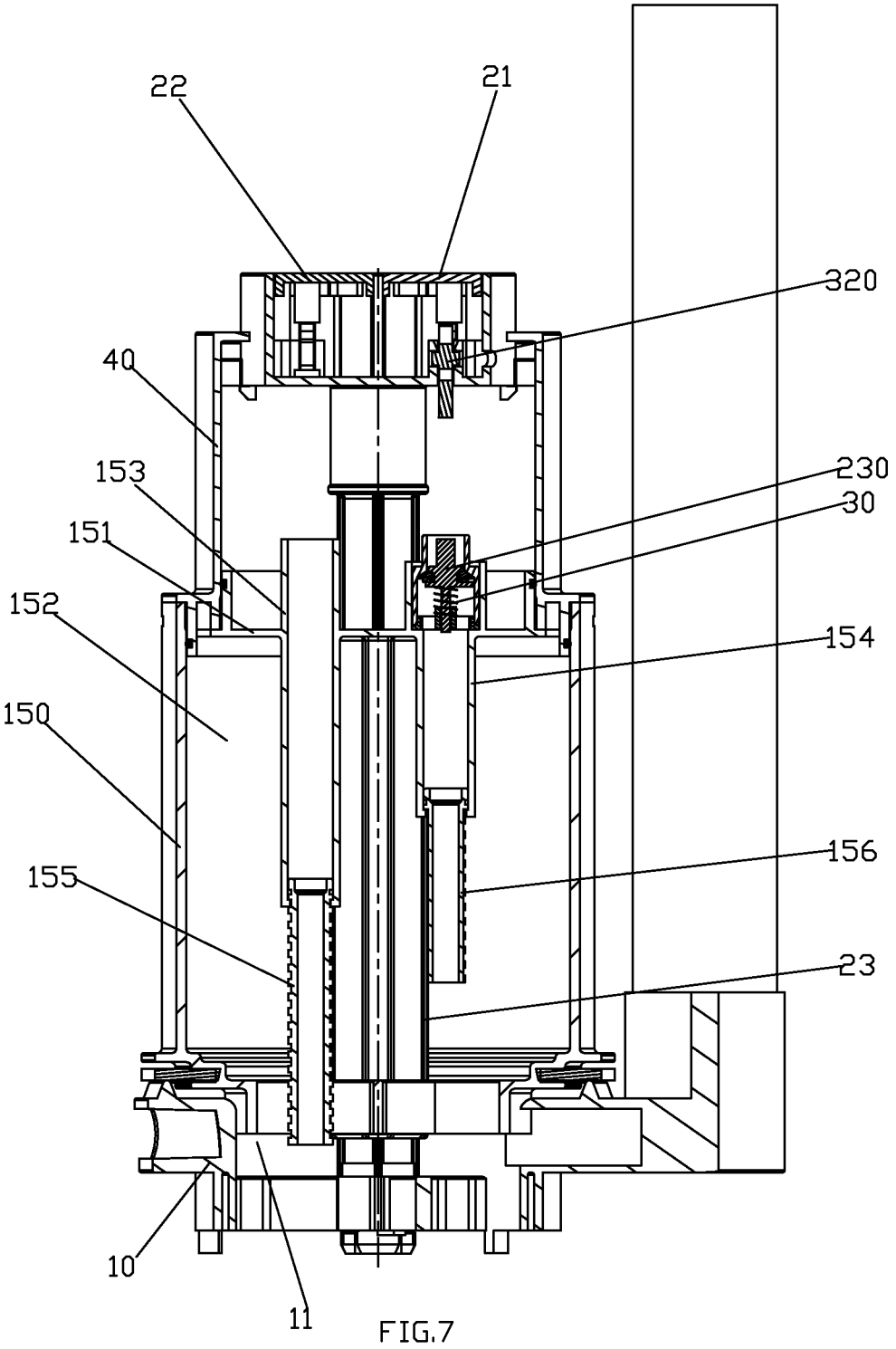
FIG. 7 illustrates a first sectional diagram of the double flow control mechanism of a soft touch drain valve of the second embodiment.
Figure 8:
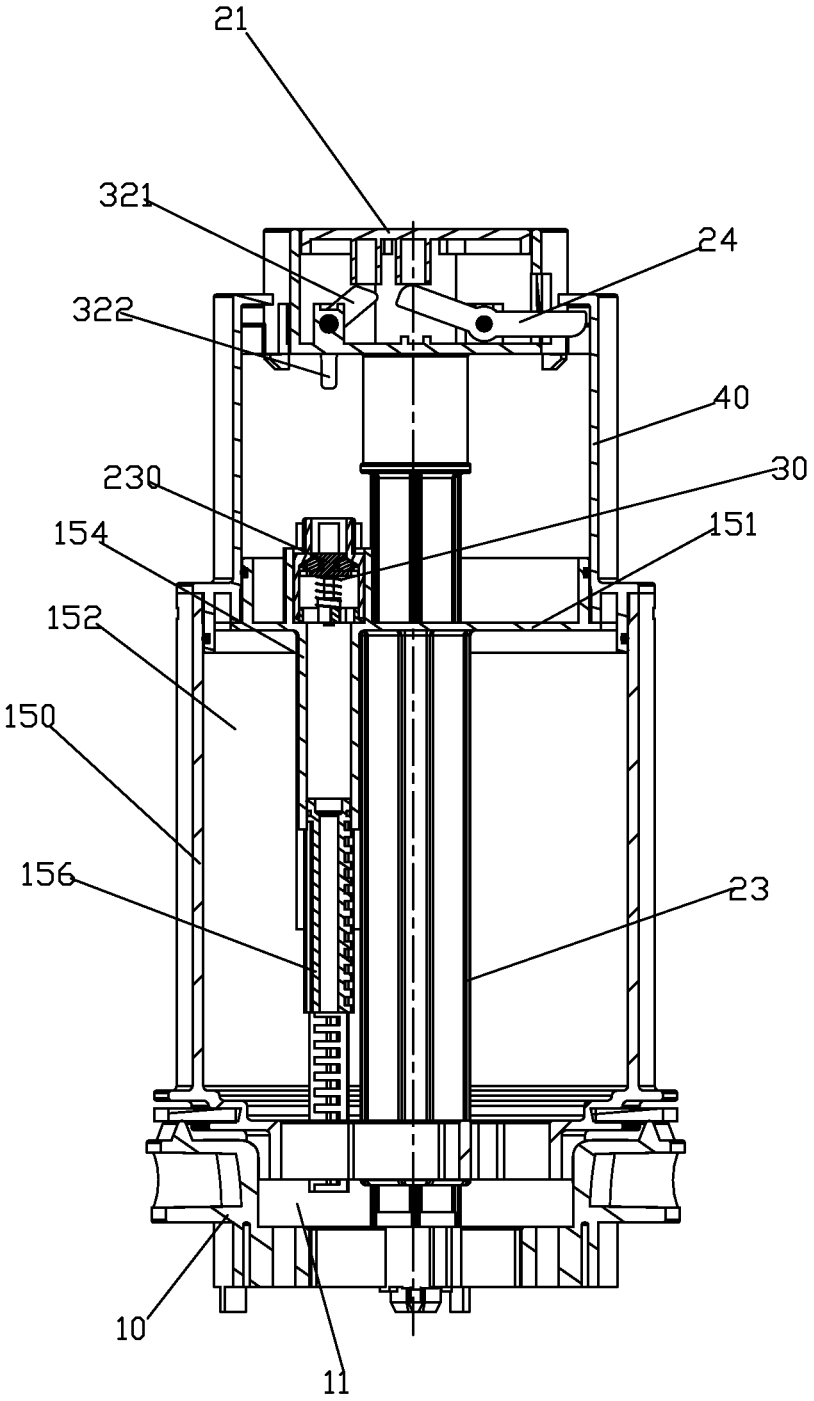
FIG. 8 illustrates a second sectional diagram of the double flow control mechanism of a soft touch drain valve of the second embodiment.
Figure 9:
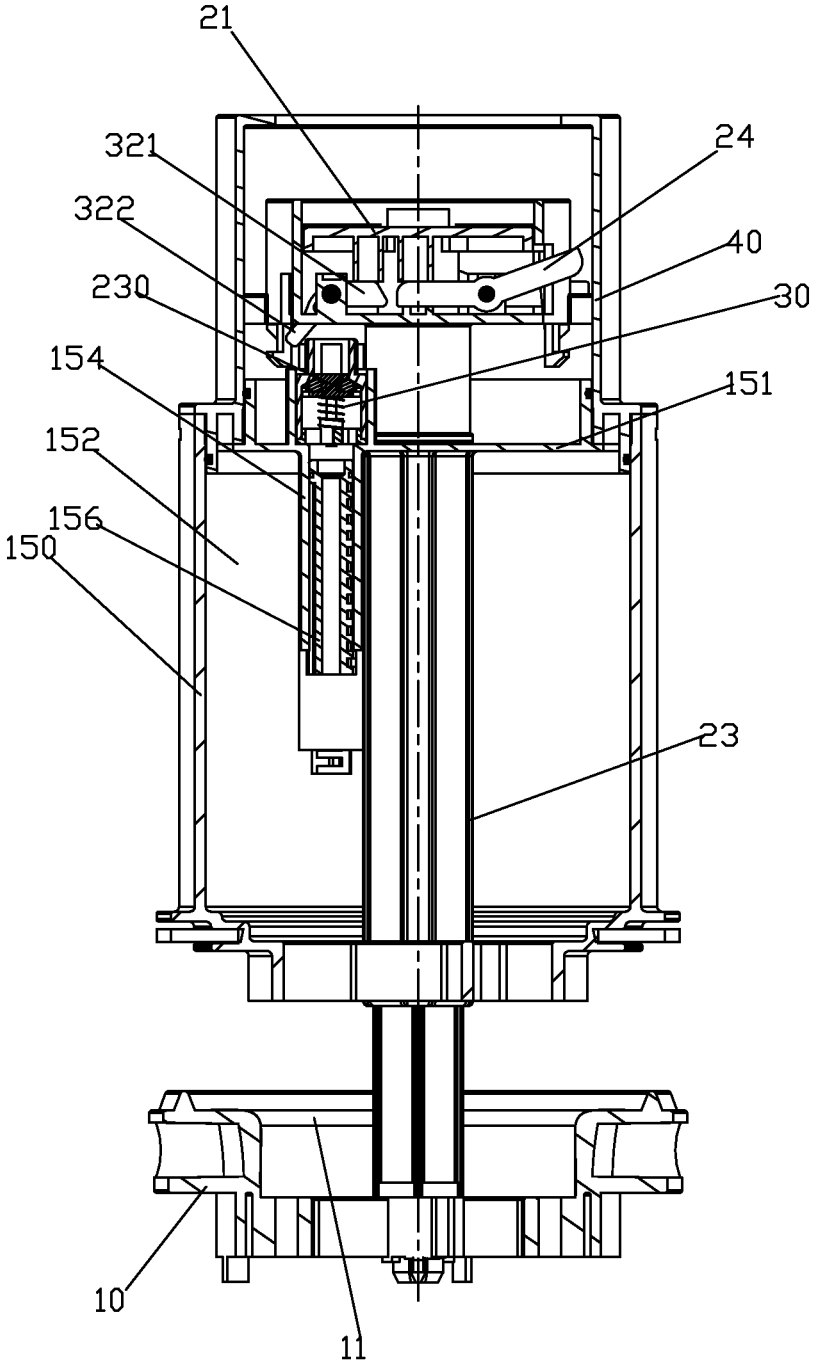
FIG. 9 illustrates a first schematic diagram of the second embodiment in the first drainage volume.
Figure 10:
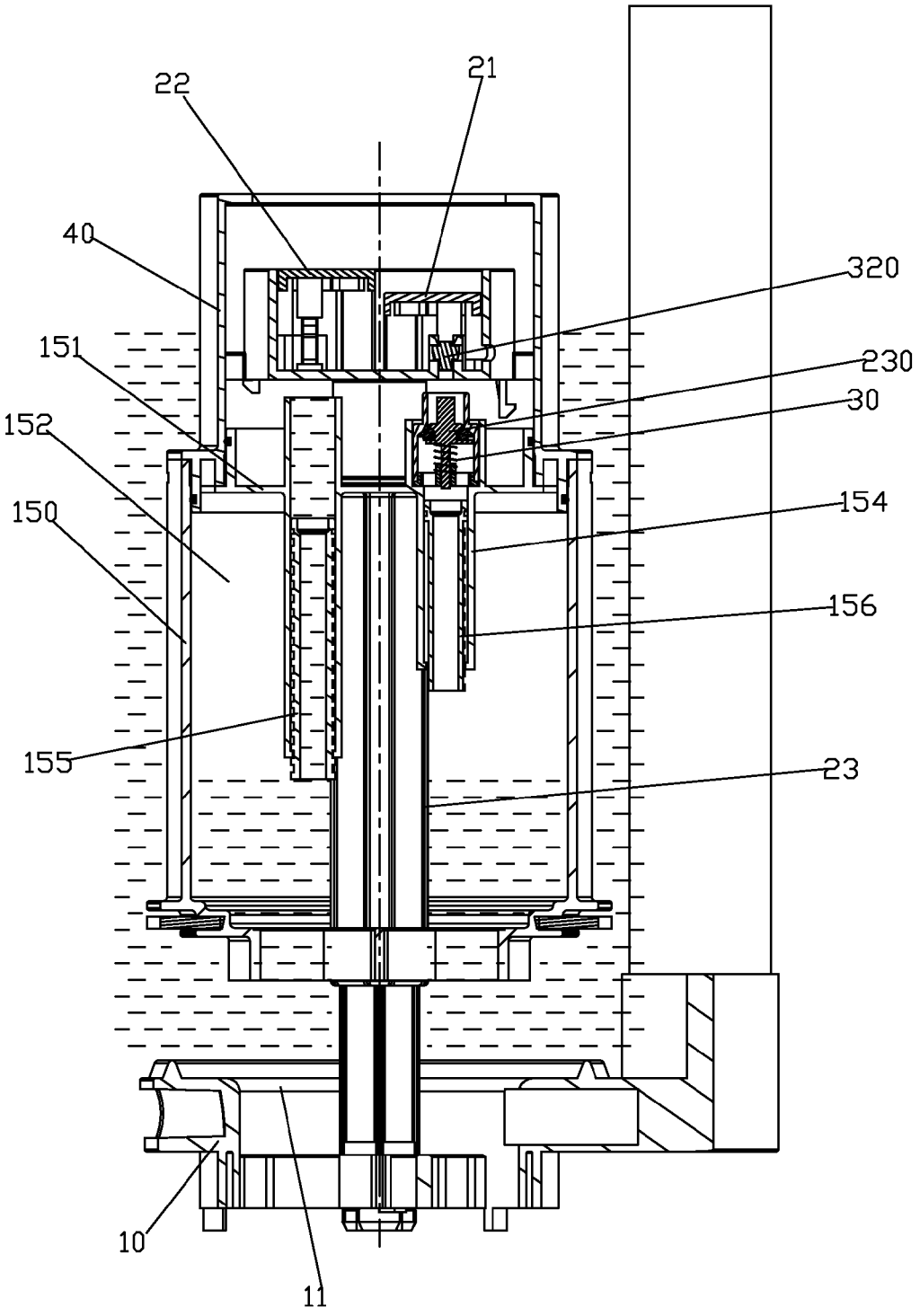
FIG. 10 illustrates a second schematic diagram of the second embodiment in the first drainage volume.
Figure 11:
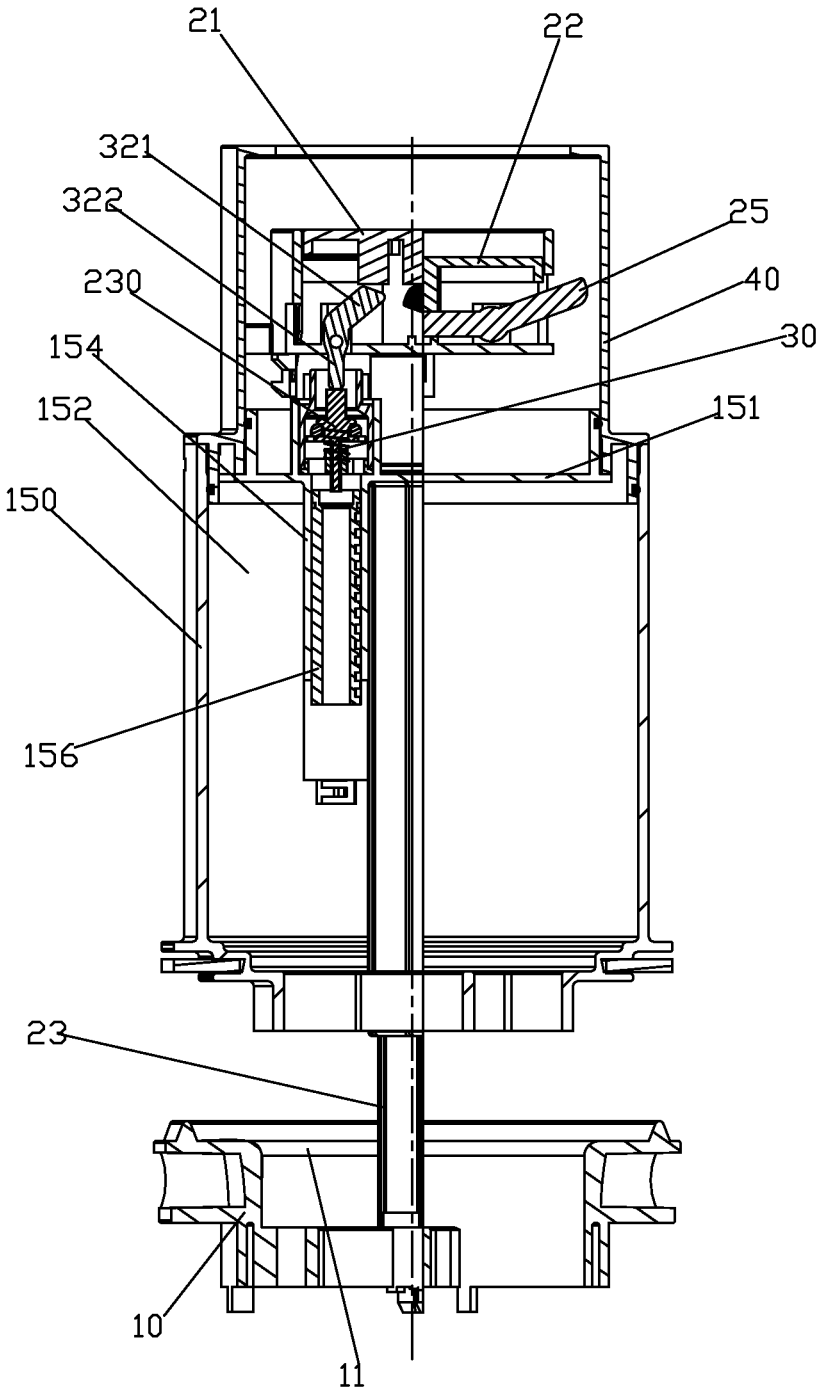
FIG. 11 illustrates a first schematic diagram of the second embodiment in the second drainage volume.
Figure 12:
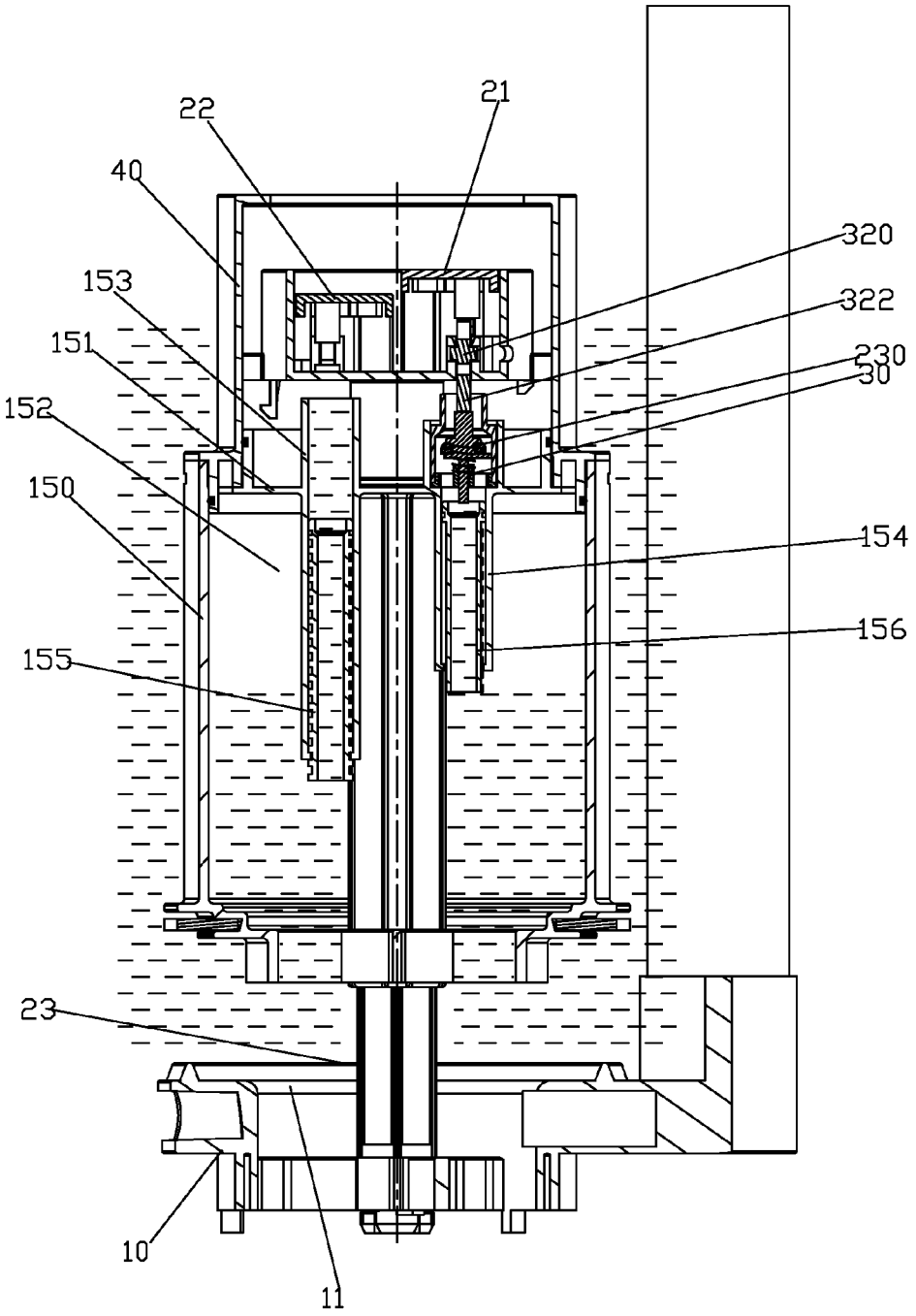
FIG. 12 illustrates a second schematic diagram of the second embodiment in the second drainage volume.
Figure 13:
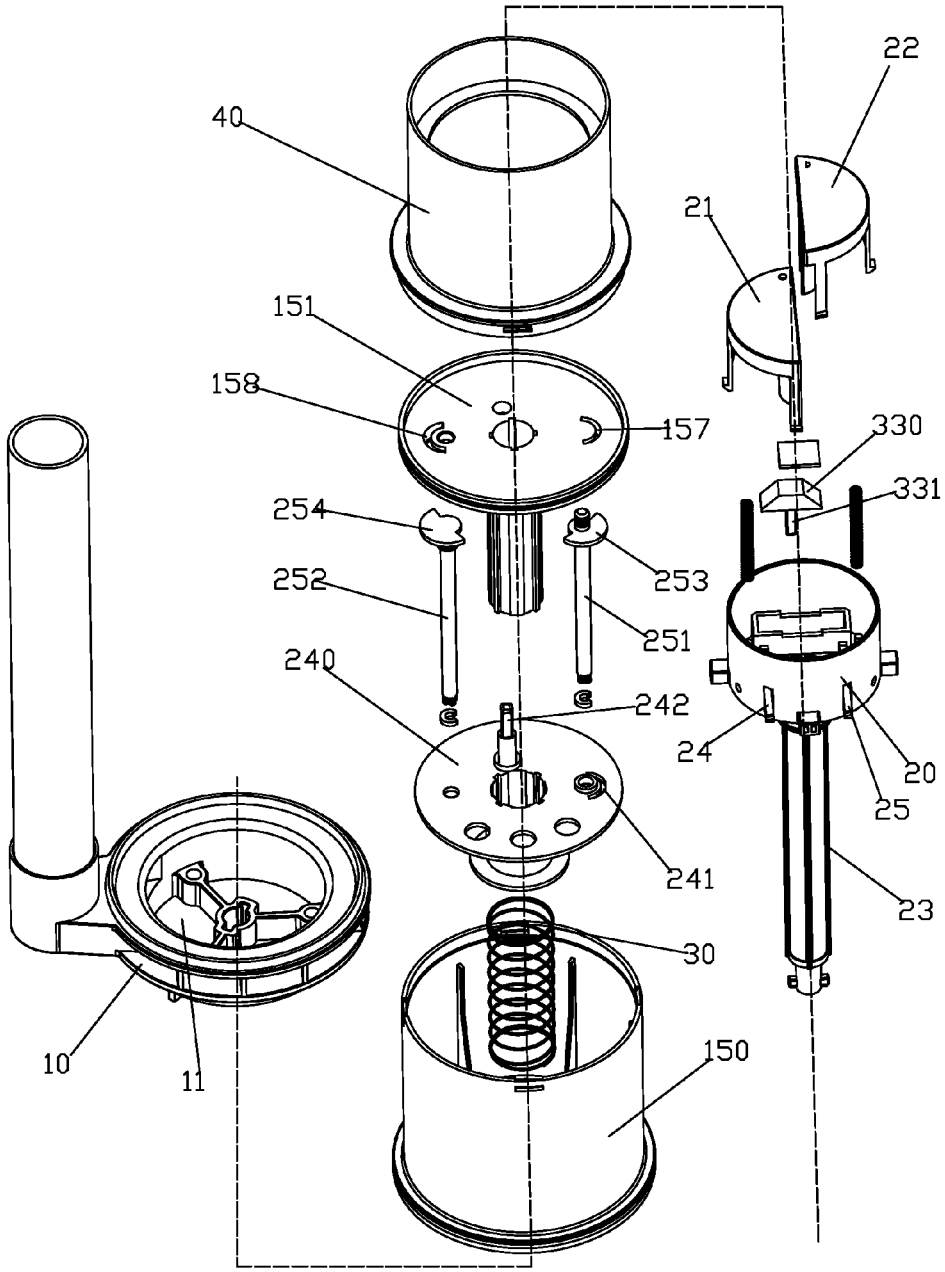
FIG. 13 illustrates an exploded and schematic diagram of a double flow control mechanism of a soft touch drain valve of a third embodiment of the present invention.
Figure 14:
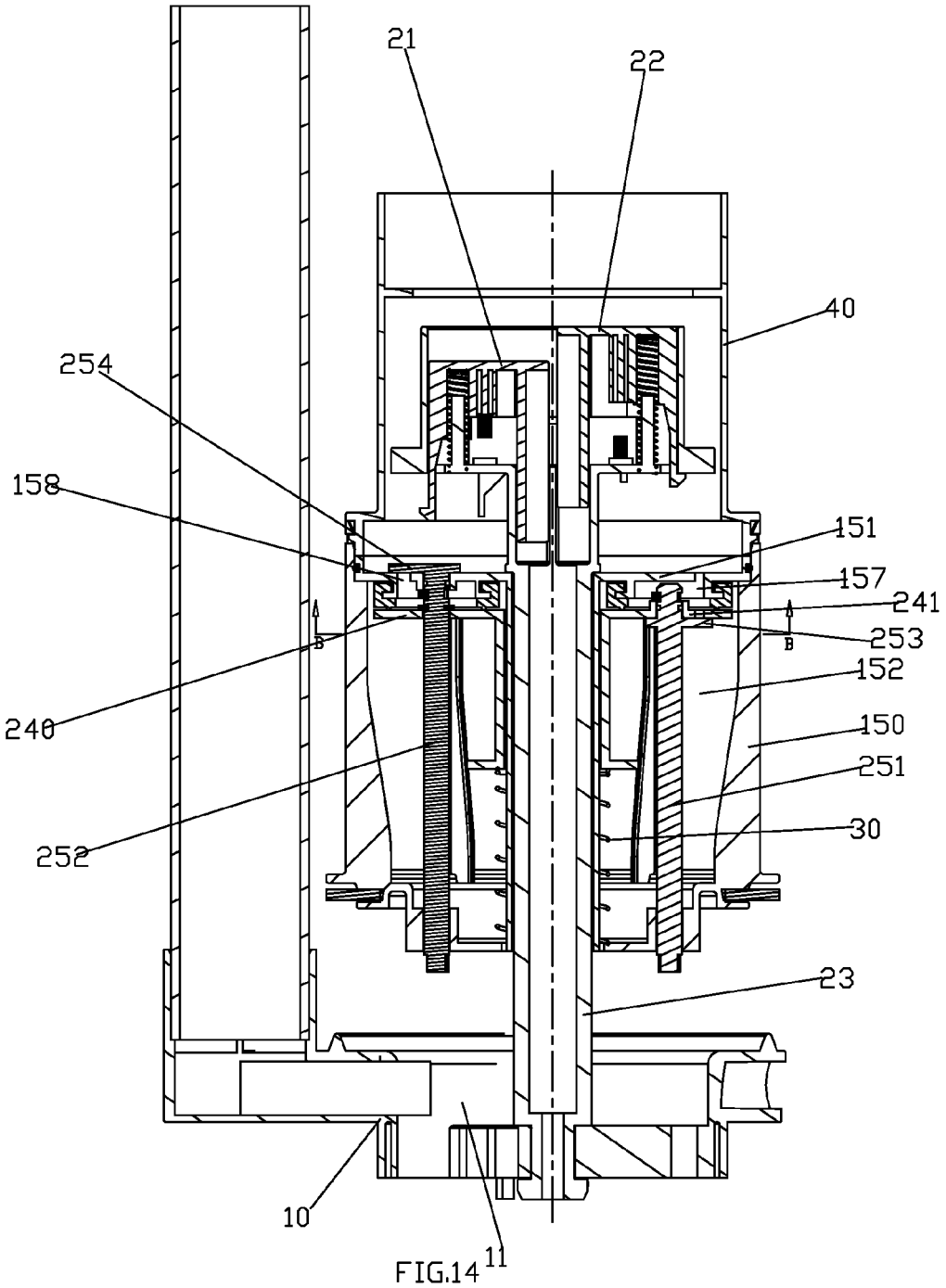
FIG. 14 illustrates a first schematic diagram of the third embodiment in the first drainage volume.
Figure 15:
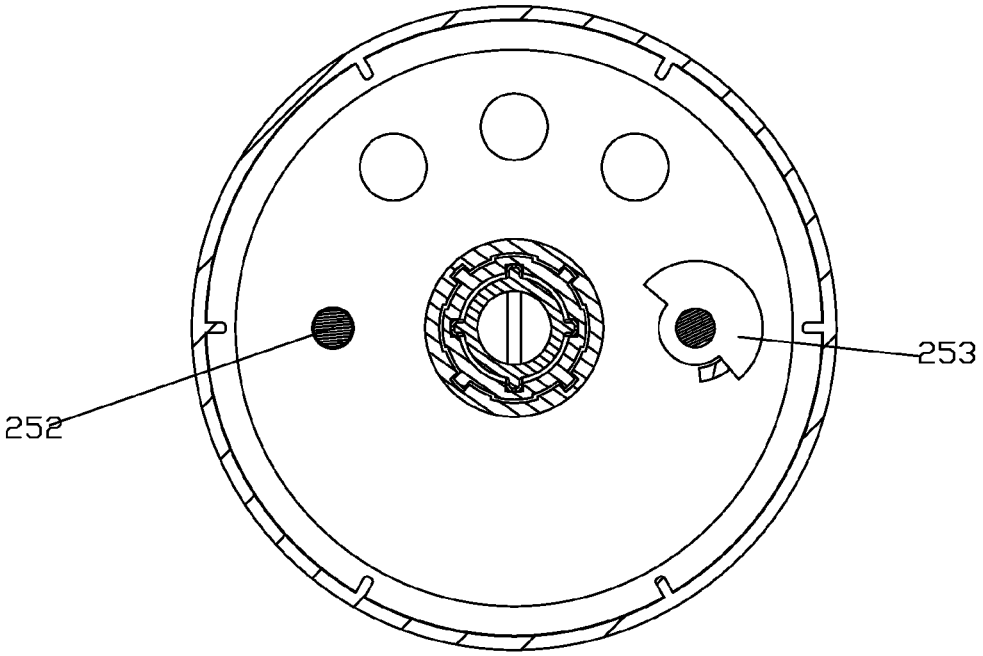
FIG. 15 illustrates a sectional diagram of FIG. 14 in B-B.
Figure 16:
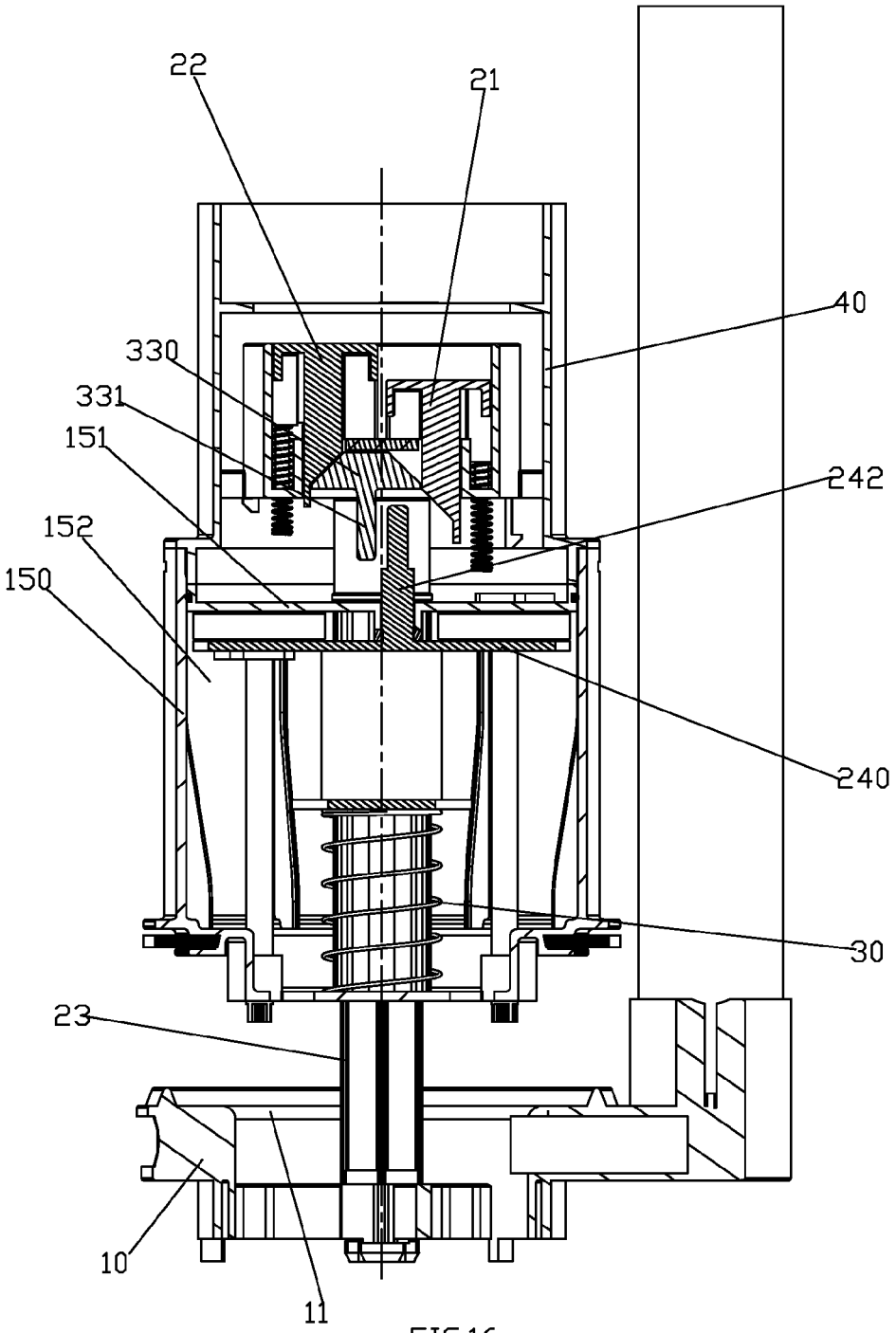
FIG. 16 illustrates a second schematic diagram of the third embodiment in the first drainage volume.
Figure 17:
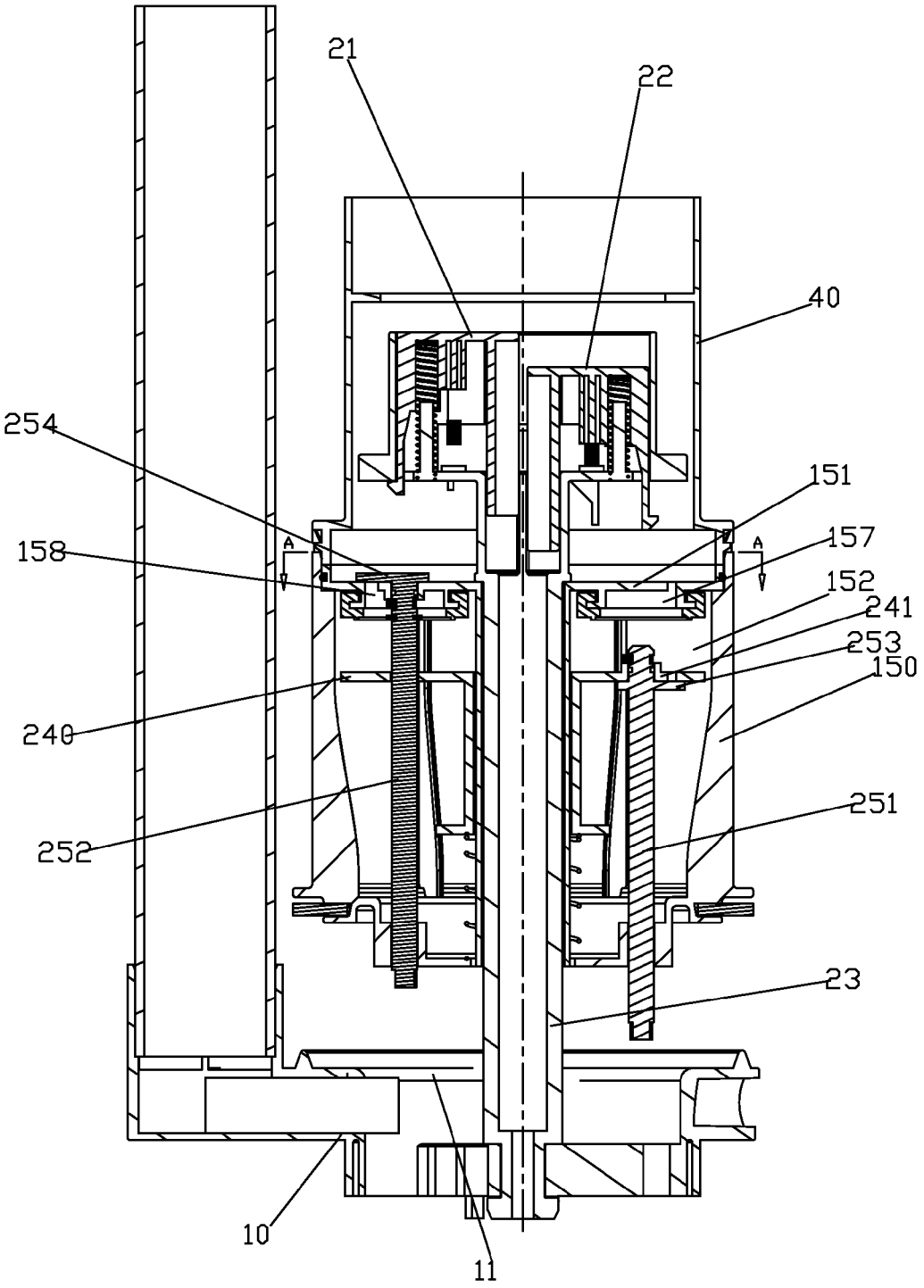
FIG. 17 illustrates a first schematic diagram of the third embodiment in the second drainage volume.
Figure 18:
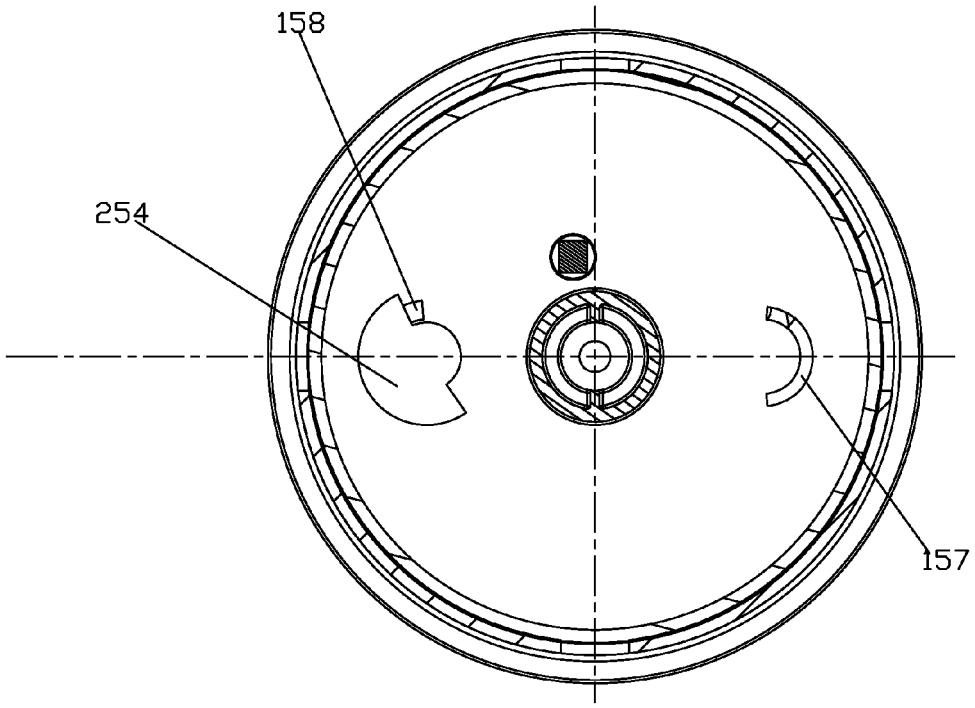
FIG. 18 illustrates a sectional diagram of FIG. 17 in A-A.
Figure 19:
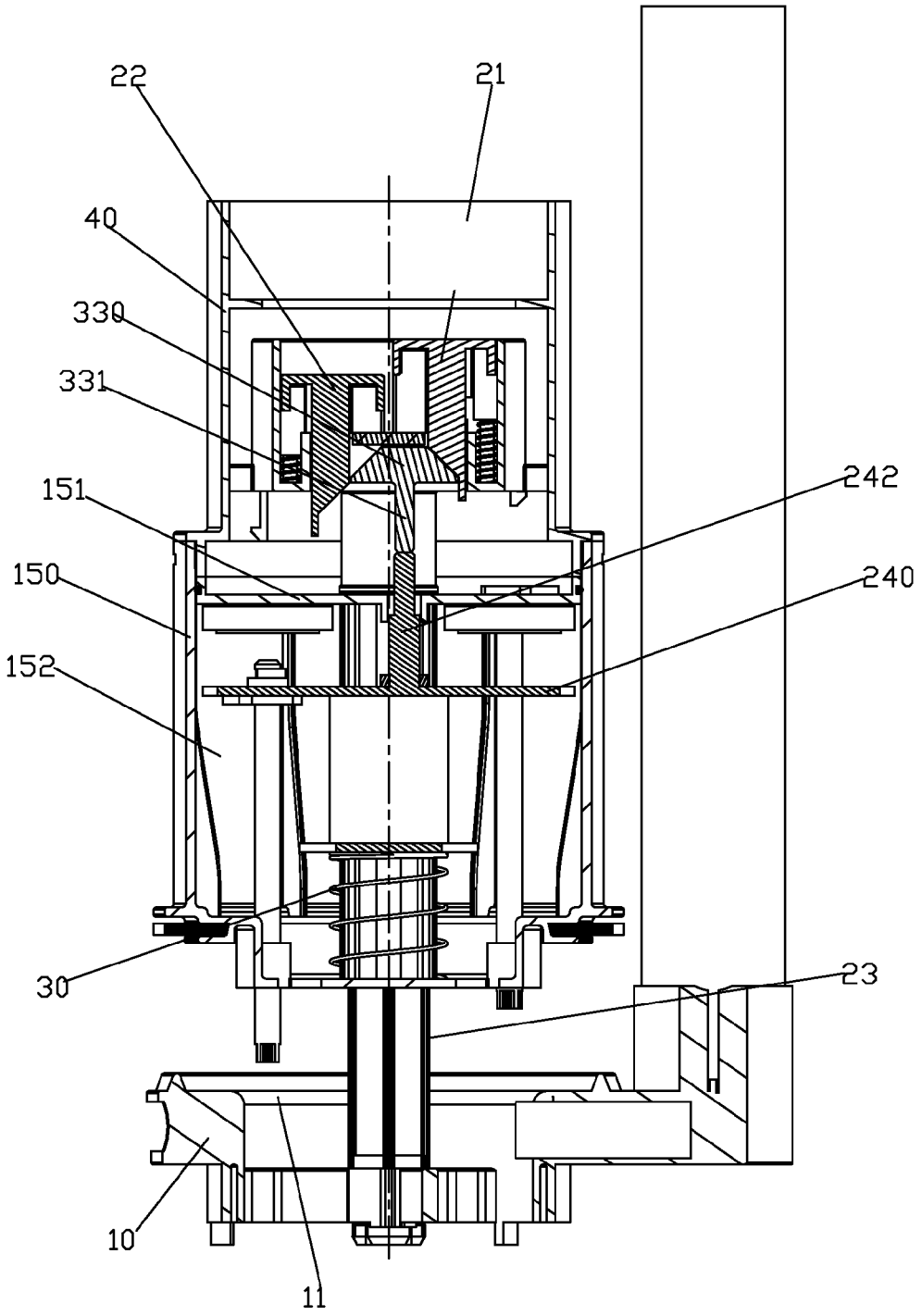
FIG. 19 illustrates a second schematic diagram of the third embodiment in the second drainage volume.
Figure 20:
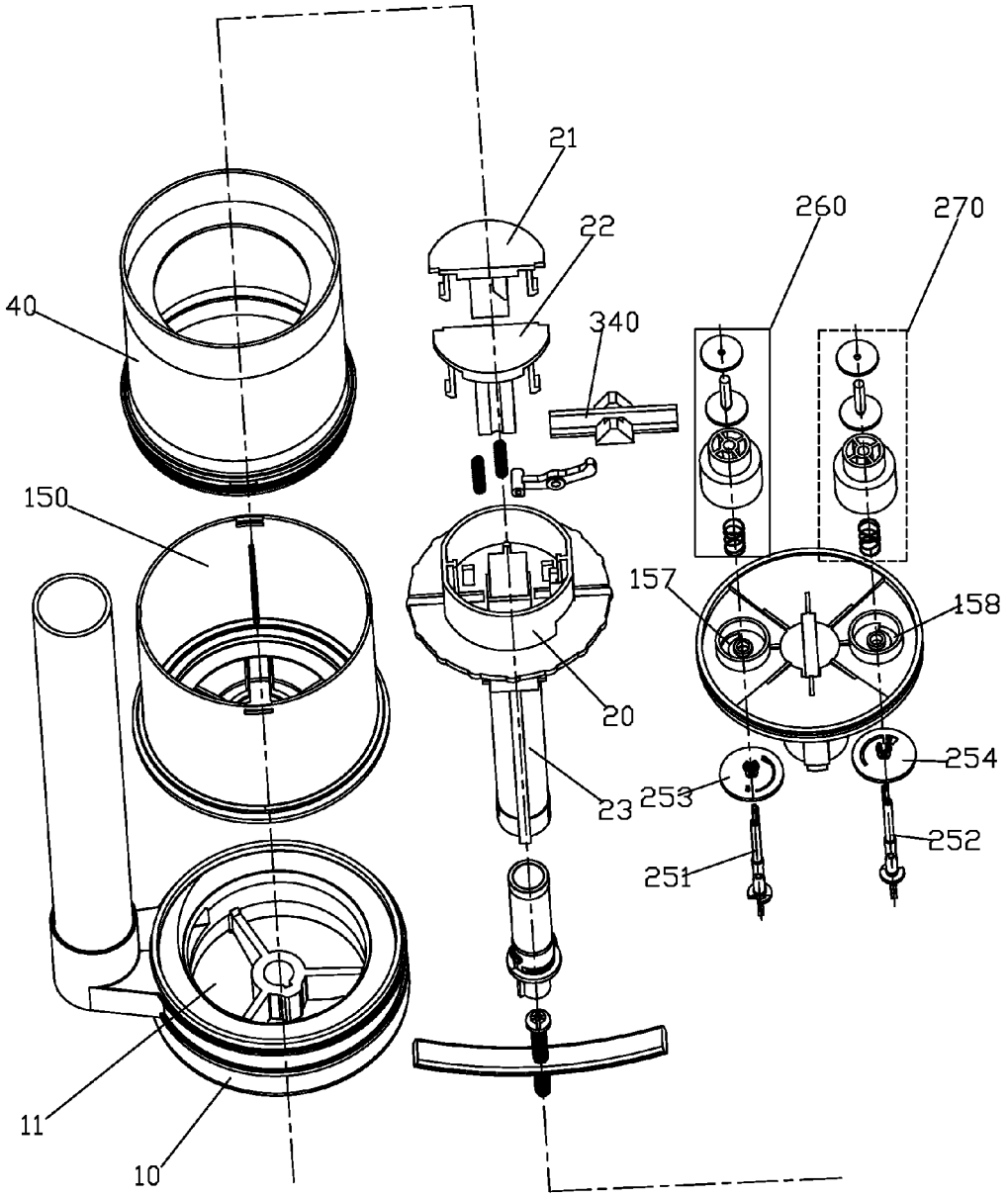
FIG. 20 illustrates an exploded and schematic diagram of a preferred structure of the double flow control mechanism of a soft touch drain valve of the third embodiment of the present invention.
Figure 21:
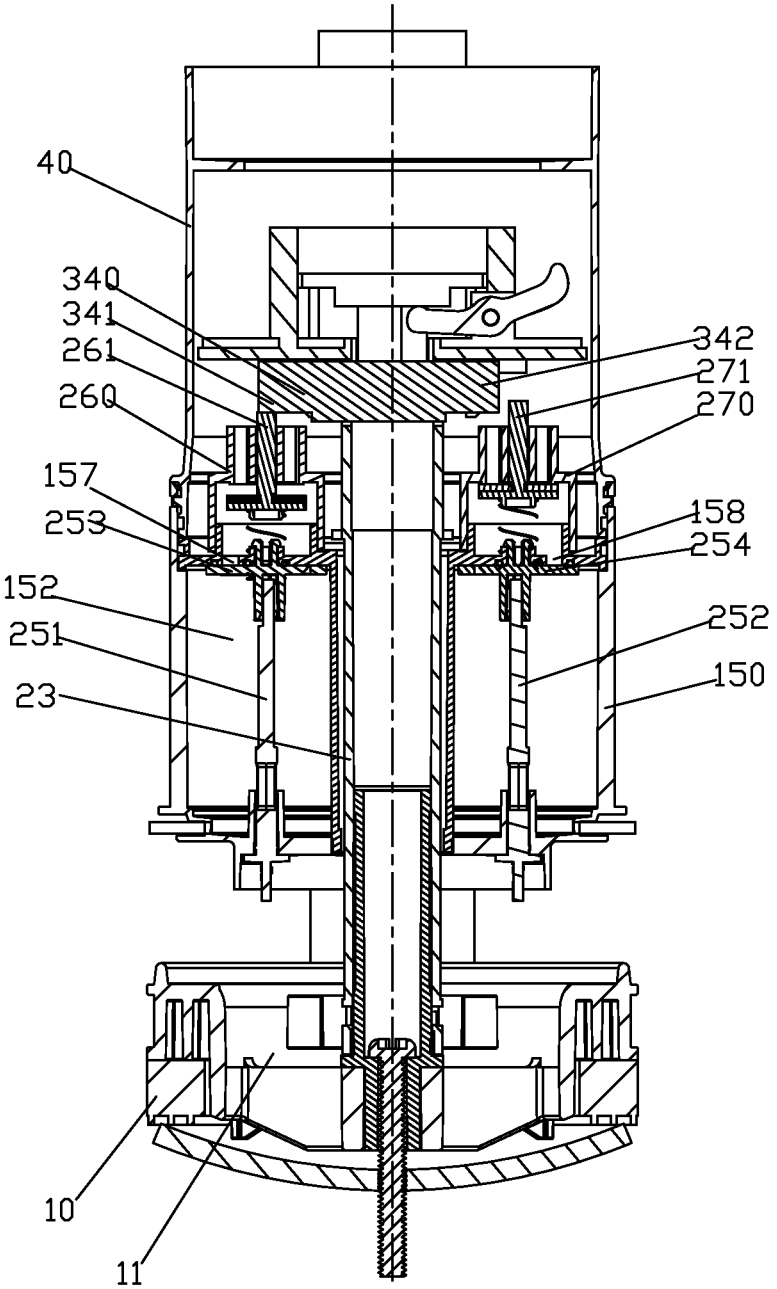
FIG. 21 illustrates a first schematic diagram of the preferred structure of the third embodiment in the first drainage volume.
Figure 22:
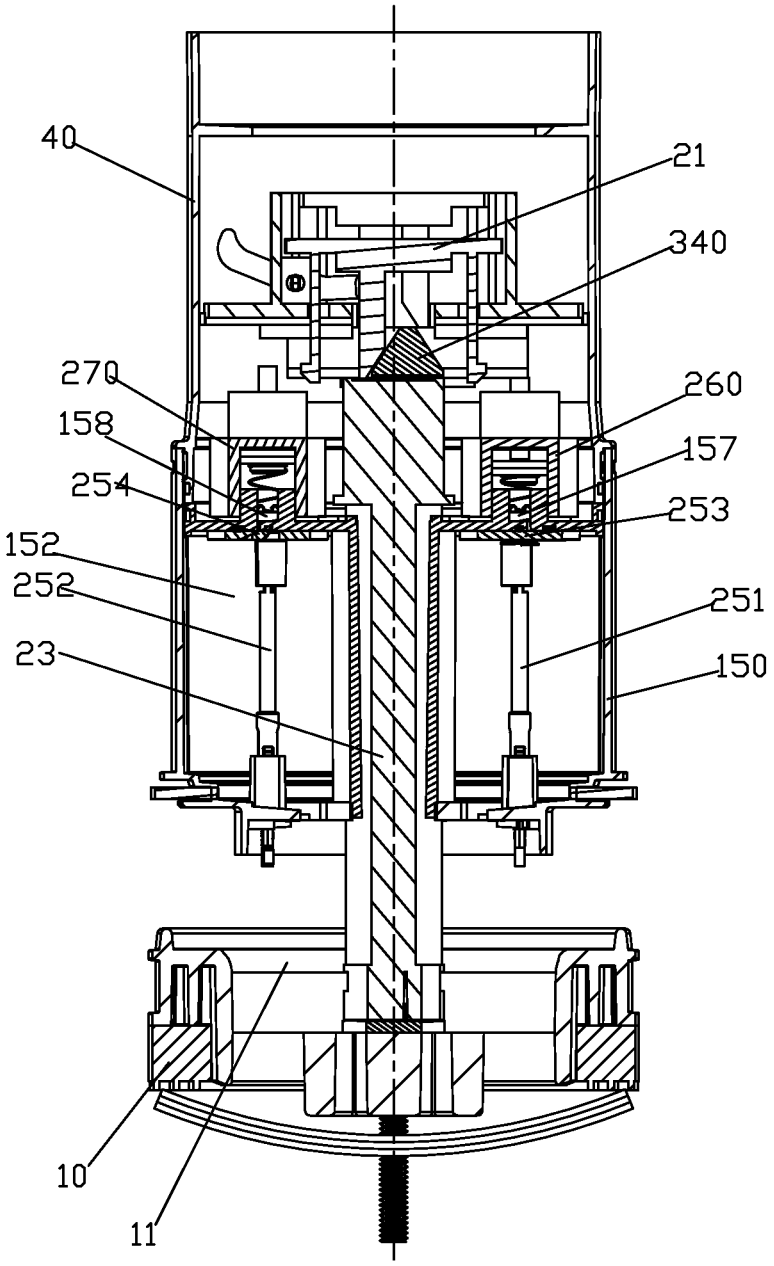
FIG. 22 illustrates a second schematic diagram of the preferred structure of the third embodiment in the first drainage volume.
Figure 23:
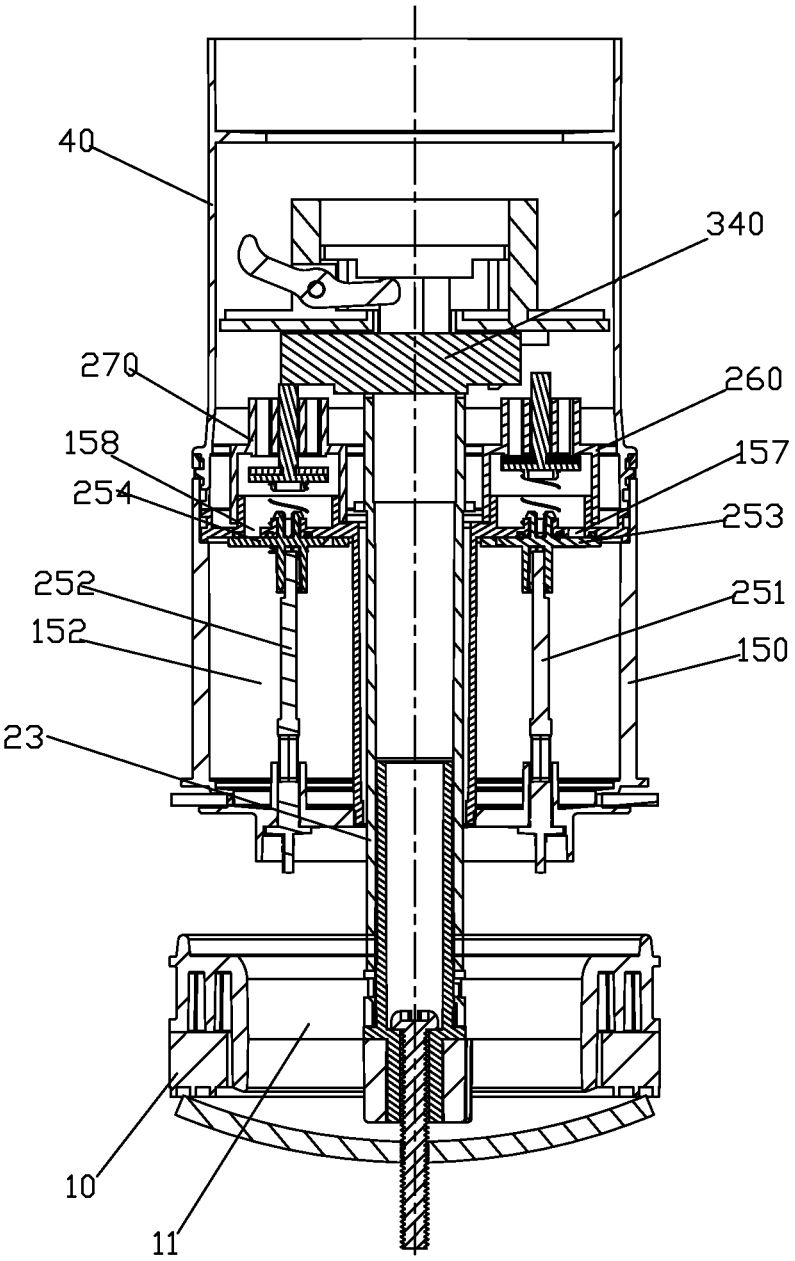
FIG. 23 illustrates a first schematic diagram of the preferred structure of the third embodiment in the second drainage volume.
Figure 24:
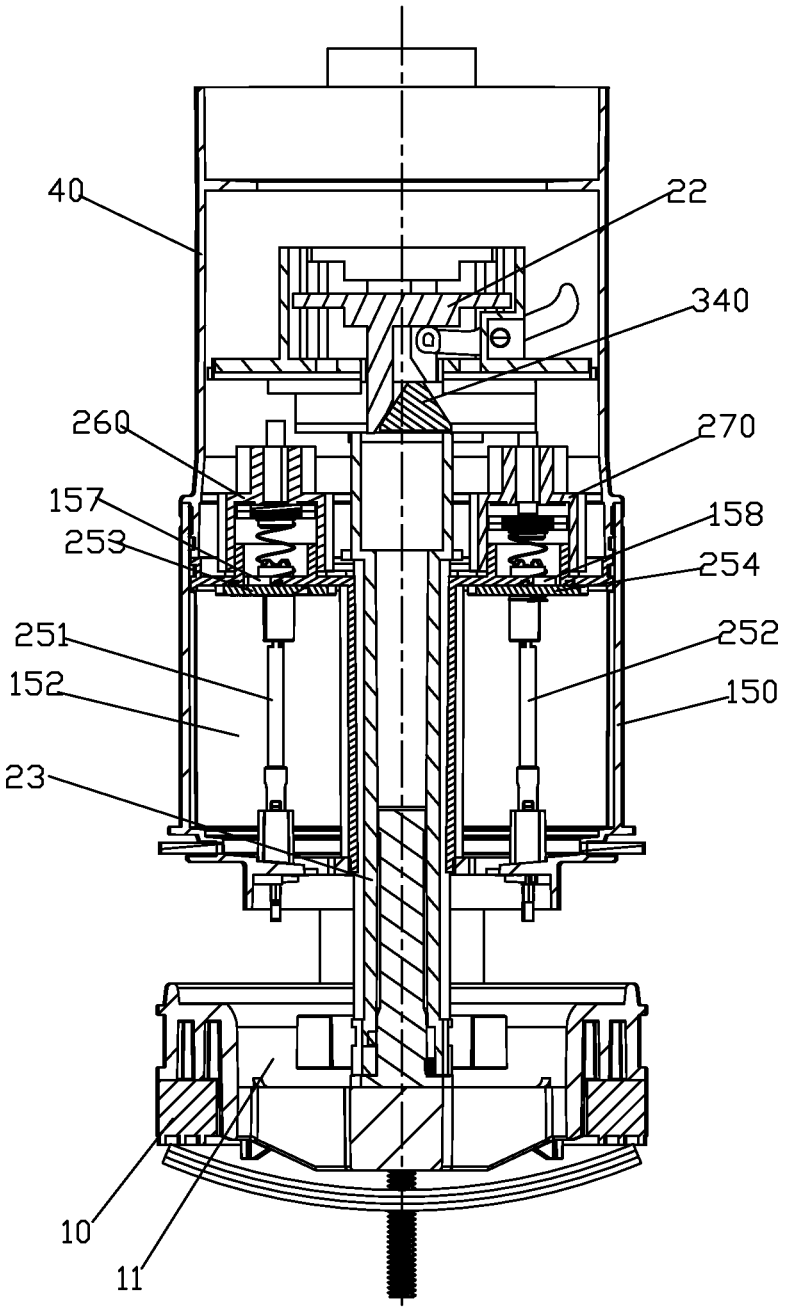
FIG. 24 illustrates a second schematic diagram of the preferred structure of the third embodiment in the second drainage volume.

Referring to FIGS. 1~5, a double flow control mechanism of a soft touch drain valve of the first embodiment comprises a base 10, a float component and a starting component.

The base 10 is disposed with a drainage opening 11, The base 10 is assembled with a valve body 20, the float component can move with relative to the base 10 to open and close the drainage opening 11.

In this embodiment, the float component comprises a hollow float 110 extending along the longitudinal axis, the hollow float 110 is sleeved on the valve body 20 to move forth and back vertically along the valve body 20.

The starting component comprises a first starting switch and a second starting switch, in this embodiment, the first starting switch comprises a first button 21 and the second starting switch comprises a second button 22.

The starting component comprises a switch element and a control element, the switch element is connected to the first starting switch and the second starting switch in driving way, the switch element can separate from the control element or abut against the control element.

The valve body 20 is assembled to the base 10, the first button 21 and the second button 22 are movably assembled to the valve body 20. And a reset spring 26 is respectively disposed between the first button 21 and the valve body 20 and between the second button 22 and the valve body 20.

In this embodiment, the valve body 20 is disposed with a guiding rod 23 to guide the float component, the guiding rod 23 is fixedly assembled to the base 10, the hollow float 110 is sleeved on the outer side of the guiding bar 23 to move forth and back vertically along the guiding rod 23; the valve body 20 is further configured with a first lift rod 24 and a second lift rod 25, the first lift rod 24 connects the first button 21 and the float component in driving way, the second lift rod 25 is connected to the second button 22 and the float component in driving way. Or in this embodiment, in other case, there is only a lift rod, the first button 21 and the second button 22 are respectively connected to the lift rod in driving way.

The float component is movably assembled to the valve body 20 and connects the first button 21 and the second button 22 in driving way, the float component is disposed with a flowing passage, the flowing passage connects the inner side and the outer side of a float chamber of the float component, the starting component controls the size of the flowing passage;

Operating the first starting switch can drive the float component to rise up, the starting component opens a smaller flowing passage, the resultant force of the float component is influenced by the smaller flowing passage so as to drain a first drainage volume of water; operating the second starting switch can drive the float component to rise up, the starting component opens a larger flowing passage, the resultant force of the float component is influenced by the larger flowing passage so as to drain a second drainage volume of water. Therein, the flowing passage can be a single flowing passage or a combination of a plurality of flowing passages, when there is only one flowing passage, the smaller flowing passage is the flowing passage when it opens smaller, the larger flowing passage is the flowing passage when it opens larger; when there are two flowing passages or more than two, the smaller flowing passage is the two or more than two flowing passages jointly opening smaller, the larger flowing passage is the two or more than two flowing passages jointly opening larger.

In the present invention, operating the first and second starting switch can respectively have a larger and smaller opening size of the flowing passage connecting the inner and outer of the float chamber, so as to achieve double flow of the drain valve, not limited by the number of the flowing passage.

The starting component comprises a switch element and a control element, the switch element is connected to the first starting switch and the second starting switch in driving way, the switch element is coupled to the control element in driving way, the control element is coupled to the flow passage, operating the first starting switch or the second starting switch can drive the control element by the switch element to control the size of the flowing passage or the on-off of the flowing passage.

In this embodiment, the flowing passage comprises a first flowing passage and a second flowing passage, pressing the first button 21 can drive the float component to rise up, the switch element separates from the control element so that the control element closes the second flowing passage, and the resultant force of the float component is influenced by the smaller flowing passage formed by the first flowing passage to drain a first drainage volume of water; pressing the second button 22 can drive the float component to rise up, the switch element abuts against the control element so that the control element open the second flowing passage, and the resultant force of the float component is influenced by the larger flowing passage formed by the first and second flowing passage to drain a second drainage volume of water;

In this embodiment, the float component comprises a float 110 and a bottom plate 120 connected to the bottom portion of the float 110, the float chamber 112 is formed between the bottom plate 120 and the float 110, the bottom plate 120 is disposed with a first inlet hole 121 and a second inlet hole 122 connecting the float chamber 112 and the drainage opening 11, the first inlet hole 121 is the first flowing passage, the second inlet hole 122 is the second flowing passage, when pressing the first button 21, water enters the float 110 through the smaller flowing passage formed by the first inlet hole 121 to drain a first drainage volume of water, when pressing the second button 22, water enters the float 110 through the larger flowing passage formed by the first inlet hole 121 and the second inlet hole 122 to drain a second drainage volume of water.

In this embodiment, the float component further comprises an assistant float 40, the assistant float 40 is locked to the upper portion of the float 110, the assistant float 40 and the float 110 are jointly movably sleeved outside the valve body 20.

In this embodiment, the float 110 is further disposed with the guiding sleeve 111 used to guide the movement of the control element.

In this embodiment, the control element is assembled inside the float 110, the control element comprises a control board 210 assembled to the lower portion of the bottom plate 120, the control board 210 is disposed with a first transition hole 211 that can be connected to the first inlet hole 121, when the switch element separates from the control element, the control board 210 is contacted with the bottom plate 120 so as to close the second inlet hole 122, and the first inlet hole 121 is connected to the first transition hole 211 to keep the first inlet hole 121 in open state, when the switch element abuts against the control element, the control board 210 separates from the bottom plate 120 so as to open the second inlet hole 122.

In this embodiment, the control element is disposed with a pressed block 220, in this embodiment, the control element is further disposed with a pushing plate 212 in the float 110, the pushing plate 212 is fixedly connected to the control board 210 by a connecting column 213 that passes through the central hole 123 of the bottom plate 120, the pressed block 220 is fixedly connected to the top end face of the pushing plate 212, the pressed block 220 passes through the guiding hole of the guiding sleeve 111.

The switch element connects the first button 21 and the second button 22 in driving way.

In this embodiment, the switch element is a slide block 310, the slide block 310 is laterally slidably assembled to the valve body 20, the slide block 310 is disposed with a pressing block 311 below the slide block 310, when pressing the first button 21, it drives the slide block 310 to slide to make the pressing block 311 separate from the pressed block 220, when pressing the second button 22, it drives the slide block 310 to slide to make the pressing block 311 abuts against the pressed block 220. In this embodiment, the valve body is disposed with a slide groove, the slide block 310 is movably assembled in the slide groove, the slide block 310 is disposed with two incline surfaces that are respectively connected to the incline surface of the first button 21 and the second button 22 in driving way.

In this embodiment, the drain valve further comprises a first adjusting piece 130 and a second adjusting piece 140 that are rotatable with relative to the bottom plate 120, the first adjusting piece 130 is disposed below the bottom plate 120, the second adjusting piece 140 is disposed above the bottom plate 120, the first adjusting piece 130 is disposed with a first adjusting hole 131 used to adjusting the size of the first inlet hole 121, the second adjusting piece 140 is disposed with a second adjusting hole 141 used to adjusting the size of the second inlet hole 122. In this embodiment, the first and second adjusting piece are respectively disposed with a rib for a hand to rotate and adjust, the rib of the second adjusting piece 141 passes through the second inlet hole 122 downwardly out of the bottom plate 120 for adjusting from the bottom portion, or the rib of the second adjusting piece 140 passes through the side wall of the float for adjusting from the side portion, the adjusting mode are not limited.

In this embodiment, the drainage valve further disposed with a reset elastic element 30 used to reset the control element, it abuts between the control element and the bottom plate 120 of the float component, the control board 210 can reset to contact with the bottom plate 120 again under the action of the reset elastic piece 30.

The working principle is that:

Pressing the first button 21, the first lift rod 24 drives the float 110 and the control element to rise up at the same time, and the first button 21 pushes the slide block 310 to move toward the second button 22, as the pressing block 311 separates from the pressed block 220, the control element moves upwardly continually, the control board 210 keeps contacting with the bottom plate 120, meanwhile the control board 210 closes the second inlet hole 122 and the first inlet hole 121 is connected to the first transition hole 211, water enters the float 110 through the first transition hole 211 and the first inlet hole 121 to increase to weight of the float 110, when the weight of the float 110 is larger than the buoyant force of the float 110, the float 110 drops down to stop water, the drainage volume at this time is the first drainage volume, as water can only enter the float 110 through the first inlet hole 121, it flows slowly, so that the float rises up longer time, it drops slowly, so that the first drainage volume is the high drainage volume.

Pressing the second button 22, the second lift rod 25 drives the float 110 and the control element to rise up at the same time, and the second button 22 pushes the slide block 310 to move toward the first button 21, as the pressing block 311 abuts against the pressed block 220, the control element can not move upwardly continually, so that the control body 210 separates from the bottom plate 120, meanwhile the control board 210 opens the second inlet hole 122, the first and the second inlet hole are open, water enters the float 110 through the first inlet hole 121 and the second inlet hole 122 to increase to weight of the float 110, when the weight of the float 110 is larger than the buoyant force of the float 110, the float 110 drops down to stop water, the drainage volume at this time is the second drainage volume, as water can enter the float 110 through the first inlet hole 121 and the second inlet hole 122, it flows quickly, so that the float rises up short time, it drops quickly, so that the second drainage volume is the low drainage volume.

By adjusting the first adjusting piece 130 and the second adjusting piece 140 to adjust the size of the first inlet hole 121 and the second inlet hole 122, the flowing rate of water to the float 110 is adjustable, so that the first drainage volume and the second drainage volume are respectively adjustable.

In a preferred substitution of this embodiment, the first inlet hole 121 forms the smaller flowing passage, the second inlet hole 122 forms the larger flowing passage independently [z1], pressing the first button 21, water enters the float 110 through the smaller flowing passage formed by the first inlet hole 121 to drain a first drainage volume of water, pressing the second button 22, water enters the float 110 through the larger flowing passage formed by the second inlet hole 122 [z2] to drain a second drainage volume of water. Correspondingly, the control element comprises a first check valve assembled to the first inlet hole 121 and a second check valve assembled to the second inlet hole 122, when the switch element separates from the second check valve, the switch element abuts against the first check valve to open the first inlet hole 121 and close the second inlet hole 122, when the switch element separates from the first check valve, the switch element abuts against the second check valve to open the second inlet hole 122 and close the first inlet hole 121.

In another preferred substitution of this embodiment, the bottom plate 120 is disposed with only an inlet hole connecting the float chamber 112 and the drainage opening 11, operating the first starting switch can open the inlet hole smaller to form the smaller flowing passage, water enters the float 110 through the smaller flowing passage to drain a first drainage volume of water, operating the second starting switch can open the inlet hole larger to form the larger flowing passage, water enters the float 110 through the larger flowing passage to drain a second drainage volume of water. When operating the first starting switch, the switch element makes the control element open the inlet hole smaller, when operating the second starting switch, the switch element makes the control element open the inlet hole larger. The switch element can be a slide block, the slide block is disposed with a first pressing block and a second pressing block, the control element is a controllable valve to control the size of the inlet hole, the controllable valve is disposed with a pressed block, pressing the first button, the first pressing block of the slide block abuts against the pressed block of the controllable valve to make the controllable valve open smaller so as to make the inlet hole open smaller; pressing the second button, the second pressing block of the slide block abuts against the pressed block of the controllable valve to make the controllable valve open larger so as to make the inlet hole open larger, thus realizing a first drainage volume and second drainage volume of the drain valve to achieve the object of the present invention, the working principle is similar to above mentioned, here is not further described.

The Second Embodiment

Referring to FIGS. 6~12, the second embodiment of the present invention differs form the first embodiment in that:

In this embodiment, the float component comprises a float 150 and a separating plate 151 assembled inside the float 150, the float chamber 152 is formed between the float 150 and the separating plate 151, the float chamber 152 is connected to the drainage opening 11, the separating plate 151 is disposed with an first exhaust pipe 153 and a second exhaust pipe 154 connecting the float 152 and the outer air, the first exhaust pipe 153 is the first flowing passage, the second exhaust pipe 154 is the second flowing passage, when operating the first button to lift the float 150, water enters the float chamber 152 to exhaust the air in the float chamber 152 out of the smaller flowing passage formed by the first exhaust pipe 153 so as to drain a first drainage volume of water, when operating the second starting switch, water enters the float chamber 152 to exhaust the air in the float chamber 152 out of the larger flowing passage jointly formed by the first and second exhaust pipe so as to drain a second drainage volume of water.

In this embodiment, when there is only a flowing passage, the smaller flowing passage means that the height of the bottom end of the exhaust pipe in the float chamber 152 is lower, the larger flowing passage means that the height of the bottom end of the exhaust pipe in the flow chamber 152 is higher; when there are two flowing passage or more, the smaller flowing passage means that the height of the bottom end of the two or more than two exhaust pipes in the float chamber 152 is lower, the larger flowing passage means that the height of the bottom end of the two or more than two exhaust pipes in the flow chamber 152 is higher.

In this embodiment, the first exhaust pipe 153 and the second exhaust pipe 154 are fixedly assembled to the separating plate 151, a first adjusting sleeve pipe 155 and a second adjusting sleeve pipe 154 are further configured that the first adjusting sleeve pipe 155 is movably sleeved on the lower portion of the first exhaust pipe 153 to adjust the height of the bottom end of the first adjusting sleeve pipe 155 in the float chamber 152 and the second adjusting sleeve pipe 156 is movably sleeved on the lower portion of the second exhaust pipe 154 to adjust the height of the bottom end of the second adjusting sleeve pipe 156 in the float chamber 152, that is to say, at this time, the first adjusting sleeve pipe 155 and the first exhaust pipe 153 jointly form the first flowing passage, the second adjusting sleeve pipe 156 and the second exhaust pipe 154 joint form the second flowing passage, adjusting the bottom end of the first adjusting sleeve pipe 155 and the second adjusting sleeve pipe 156 in the float chamber is actually adjusting the height of the air inlet end of the first flowing passage and the second flowing passage in the float chamber 152, or as needed, the first exhaust pipe 153 and the second exhaust pipe 154 are vertically movably assembled to the separating plate 151 to adjust the height of the bottom end of the first exhaust pipe 153 and the second exhaust pipe 154 in the float chamber 152, or in another case, the first exhaust pipe 153 and the second exhaust pipe 154 are fixedly assembled to the separating plate 151 without adjusting function, only if making the bottom end of the first exhaust pipe 153 and the second exhaust pipe 154 with different height in the float chamber can achieve double flow of the soft touch drain valve of the present invention, the detailed structure is not limited.

In this embodiment, the bottom end of the first exhaust pipe 153 has the height lower than that of the second exhaust pipe 154.

The control element is assembled to the third check valve 230 in the second exhaust pipe 154, when the switch element separates from the control element, the third check valve 230 closes the second exhaust pipe 154, when the switch element abuts against the control element, the third check valve 230 opens the second exhaust pipe 154. In this embodiment, the reset elastic element 30 used to reset the control element is assembled inside the float and abuts between the third check valve 230 and the second exhaust pipe 154.

In this embodiment, the switch element is a pendulum rod 320 rotatably connected to the valve body 20, the pendulum rod 320 has a first pendulum block 321 and a second pendulum block 322, the first pendulum block 321 is coupled to the first button 21 in driving way, pressing the first button 21 can drive the pendulum rod 320 to swing to make the second pendulum block 322 separate from the third check valve 230, pressing the second button 22, the pendulum rod 320 keeps still to make the second pendulum block 322 abuts against the third check valve 230.

The work principle is that:

Pressing the first button 21, the first lift rod 24 drives the float 150 and the control element to rise up at the same time, meanwhile, the first button 21 drives the pendulum rod 320 to swing to make the second pendulum block 322 separate from the third check valve 230, the third check valve 230 then closes the second exhaust pipe 154, the first exhaust pipe 153 keeps connecting the float chamber 152 and the outer air, Water enters the float chamber 152 to exhaust the air in the float chamber 152 out through the first exhaust pipe 153, at the same time, the water level of the float chamber 152 rises up to basically align to the bottom end of the first adjusting sleeve pipe 155, as the height of the bottom end of the first adjusting sleeve pipe 155 is lower than the bottom end of the second adjusting sleeve pipe 156, air of the float chamber 152 is exhausted less, the buoyancy force of the float 150 is larger, the float 150 drops slowly with the falling of the water level, so that the drainage volume at this time is the first drainage volume, that is the high drainage volume.

Pressing the second button 22, the second lift rod 25 drives the float 150 and the control element to rise up at the same time, meanwhile, the second button 22 doesn't drive the pendulum rod 320 to swing so that the pendulum rod 320 keeps in the initial state, the second pendulum block 322 abuts against the third check valve 230, the third check valve 230 then opens the second exhaust pipe 154, the first exhaust pipe 153 and the second exhaust pipe 154 keep connecting the float chamber 152 and the outer air, water enters the float chamber 152 to exhaust the air in the float chamber 152 out through the first and the second exhaust pipe, at the same time, the water level of the float chamber 152 rises up to basically align to the bottom end of the second adjusting sleeve pipe 156, as the height of the bottom end of the second adjusting sleeve pipe 156 is higher than the bottom end of the first adjusting sleeve pipe 155, air of the float chamber 152 is exhausted more, the buoyancy force of the float 150 is less, the float 150 drops quickly with the falling of the water level, so that the drainage volume at this time is the second drainage volume, that is the low drainage volume.

In this embodiment, adjusting the first adjusting sleeve pipe 155 and the second adjusting sleeve pipe 156 can respectively adjust the height of the bottom end of the first and second flowing passage so as to control the water level in the float chamber 152 to control the buoyancy force of the float chamber 152, so that the float 150 in different buoyancy force has different dropping period, the first drainage volume and the second drainage volume are adjustable respectively, so that the first drainage volume can be adjusted to low drainage volume and the second drainage volume can be adjusted to high drainage volume.

In this embodiment, the third check valve 230 is a normal close check valve, it can be a normal open check valve as needed. The third check valve 230 also can be disposed in the first exhaust pipe 153.

In other case, as the preferred substitution of this embodiment, the first exhaust pipe 153 forms the smaller flowing passage, the second exhaust pipe 154 forms the larger flowing passage independentlyl [z3], when pressing the first button 21, the float 150 is lifted up, water enters the float chamber 152 to exhaust the air in the float chamber 152 out of the smaller flowing passage formed by the first exhaust pipe 153 so as to drain a first drainage volume of water, when pressing the second button 22, the float 150 is lifted up, water enters the float chamber 152 to exhaust the air in the float chamber 152 out of the larger flowing passage formed by the second exhaust pipe 154 so as to drain a second drainage volume of water. Correspondingly, the control element comprises a first check valve assembled to the first exhaust pipe and a second check valve assembled to the second exhaust pipe, when the switch element separates from the second check valve, the switch element abuts against the first check valve to open the first exhaust pipe and close the second exhaust pipe, when the switch element separates from the first check valve, the switch element abuts against the second check valve to open the second exhaust pipe and close the first exhaust pipe, thus achieving the object of the present invention, there is no further described hereafter.

In other case, as a preferred substitution of this embodiment, the separating plate 151 is just disposed with an exhaust pipe connecting the float 152 and the outer air, when operating the first starting switch, the bottom end of the exhaust pipe is lower in the float chamber 152 to form the smaller flowing passage, water enters the float chamber 152 to exhaust the air in the float chamber 152 out of the smaller flowing passage so as to drain a first drainage volume of water, when operating the second starting switch, the bottom end of the exhaust pipe is higher in the float chamber to form the larger flowing passage, water enters the float chamber 152 to exhaust the air in the float chamber 152 out of the larger flowing passage so as to drain a second drainage volume of water, when operating the first starting switch, the switch element makes the control element control the bottom end of the exhaust pipe lower in the float chamber 152, when operating the second starting switch, the switch element makes the control element control the bottom end of the exhaust pipe higher in the float chamber, it can also achieve the object of the present invention, the work principle is similar to above mentioned that here is no further description.

The Third Embodiment

Referring to FIGS. 13~19, the third embodiment of a double flow control mechanism of a soft touch drain valve differs from the second embodiment in that:

In this embodiment, the first flowing passage is the first exhaust hole 157, the second flowing passage is the second exhaust hole 158, The control element is movably assembled inside the float chamber 152, the control element comprises a control board 240, the control board 240 is disposed with a second transition hole 241 connected to the first exhaust hole 157, when the switch element separates from the control element, the control board 240 is contacted with the separating plate 151 to close the second exhaust hole 158 and the first exhaust hole 157 is connected to the second transition hole 241 to keep the first exhaust hole 157 in open state, when the switch element abuts against the control element, the control board 240 separates from the separating plate 151 to open the second exhaust hole 158.

In this embodiment, the switch element is a slide block 330, the slide block 330 is laterally slidably assembled to the valve body 20 and connects the first button 21 and the second button 22 in driving way, the slide block 330 is disposed with a pressing block 331 below the slide block 330, when pressing the first button 21, it drives the slide block 330 to slide to make the pressing block 331 separate from the pressed block 242, when pressing the second button 22, it drives the slide block 330 to slide to make the pressing block 331 abut against pressed block 242. The structure of the switch element has similar structure with the first embodiment.

In this embodiment, a first adjusting rod 251 and second adjusting rod 252 are movably assembled to the control element, the top end of the first adjusting rod 251 is disposed with a first adjusting portion 253, the top end of the second adjusting rod 252 is disposed with a second adjusting portion 254, the first adjusting portion 253 is located below the second transition hole 241 to adjust the size of the second transition hole 241, the second adjusting portion is located above the second exhaust hole 158 to adjust the size of the second exhaust hole 158.

The drainage principle of the drain valve of this embodiment is that:

Pressing the first button 21, the first lift rod 24 drives the float 150 and the control element to rise up at the same time, meanwhile, the first button 21 pushes the slide block 330 to move towards the second button 22, as the pressing block 331 separates from the presses block 242, the control element moves upwardly continually until the control board 240 is contacted with the separating plate 151 so as to close the second exhaust hole 158, and the first exhaust hole 157 is connected to the second transition hole 241 to make the first exhaust hole 157 keep in open state, the first exhaust hole 157 keeps connecting the float chamber 152 and the outer air, water enters the float chamber 152 to exhaust the air in the float chamber 157 out of the first exhaust hole 157, as air can only exhaust out of the first exhaust hole 157, it exhausts slowly, thus air in the float chamber 152 exhaust out less, the rest air in the float 150 is more and the buoyancy force of the float 150 is larger, the float 150 drops slowly with the falling of the water level, so that the drainage volume at this time is the first drainage volume, that is the high drainage volume.

Pressing the second button 22, the second lift rod 25 drives the float 150 and the control element to rise up at the same time, meanwhile, the second button 22 pushes the slide block 330 to move towards the first button 21, as the pressing block 331 abuts against the presses block 242, the control element can not move upwardly any more, the control board 240 separate from the separating plate 151 so as to open the second exhaust hole 158, and the first exhaust hole 157 and the second exhaust hole 158 keep connecting the float chamber 152 and the outer air, water enters the float chamber 152 to exhaust the air in the float chamber 152 out through the first and the second exhaust hole 157,158 jointly, as air can exhaust out through the first and the second exhaust hole 157,158, it exhausts quickly, thus air in the float chamber 152 exhaust out more, the rest air in the float 150 is less and the buoyancy force of the float 150 is less, the float 150 drops quickly with the falling of the water level, so that the drainage volume at this time is the second drainage volume, that is the low drainage volume.

At the same way, in this embodiment, adjusting the first adjusting rod 251 and the second adjusting rod 252 can respectively adjust the size of the first exhaust hole 157 and the second exhaust hole 158 so as to control the exhaust speed of the air when water enters the float chamber 152, so as to adjust the buoyancy force of the float 150, thus achieving the respectively adjusting of the first and second drainage volume. The first drainage volume can be adjusted to low drainage volume and the second drainage volume can be adjusted to high drainage volume.

In other case, as a preferred substitution of this embodiment, as figured in FIGS. 20~24, the first exhaust hole 157 forms the smaller flowing passage and the second exhaust hole independently forms the larger flowing passage, pressing the first button 21, water enters the float chamber 152 to exhaust the air in the float chamber 152 out through the smaller flowing passage formed by the first exhaust hole 157 to drain the first drainage volume of water, pressing the second button 22, water enters the float chamber 152 to exhaust the air in the float chamber 152 out through the larger flowing passage independently formed by the second exhaust hole 158 to drain the second drainage volume of water. Correspondingly, the control element comprises a first check valve 260 assembled to the first exhaust hole 157 and a second check valve 270 assembled to the second exhaust hole 158, the switch element 340 is disposed with a first pressing block 341 and a second pressing block 342, the first check valve 260 and the second check valve 270 are respectively disposed with a first pressed block 261 and a second pressed block 271 that can separate from the first pressing block 341 and the second pressing block 342 or abut against the first pressing block 341 and the second pressing block 342, when the switch element separates from the second check valve 270, the first pressing block 341 abuts against the first pressed block 261 to open the first exhaust hole 157 and close the second exhaust hole 158, when the switch element separates from the first check valve 260, the second pressing block 342 abuts against the second pressed block 271 to open the second exhaust hole 158 and close the first exhaust hole 157.

In this embodiment, the first starting switch is a first button 21 and the second starting switch is a second button 22 that are movably assembled to the valve body 20, the switch element is a slide block 340, the slide block 340 is laterally slidably assembled to the valve body 20 and connects the first button 21 and the second button 22 in driving way.

Pressing the first button 21 can open the first exhaust hole 157 independently, pressing the second button 22 can open the second exhaust hole 158 independently, only if disposing the first and second exhaust hole with different size, so that the drainage volume is different to achieve the double flow of the soft touch drain valve of the present invention, the work principle is similar to above mentioned, here is no longer described.

Figure 25:
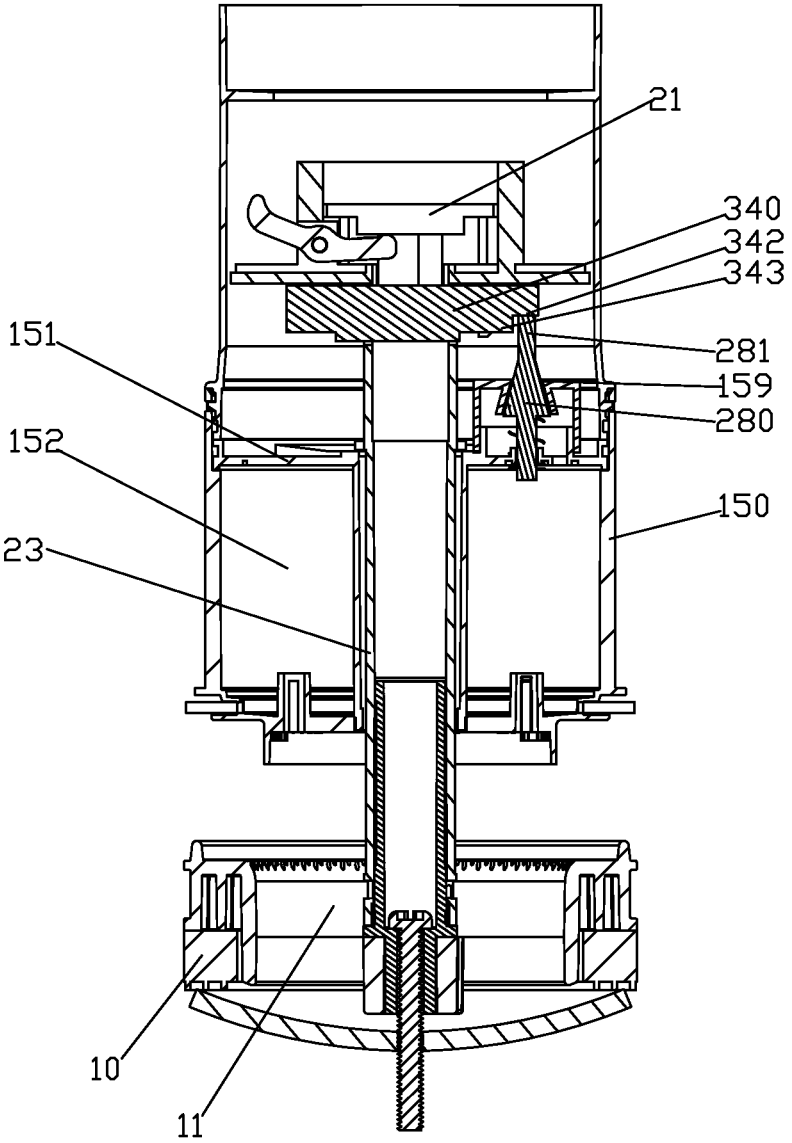
FIG. 25 illustrates a schematic diagram of another preferred structure of the third embodiment in the first drainage volume.
Figure 26:
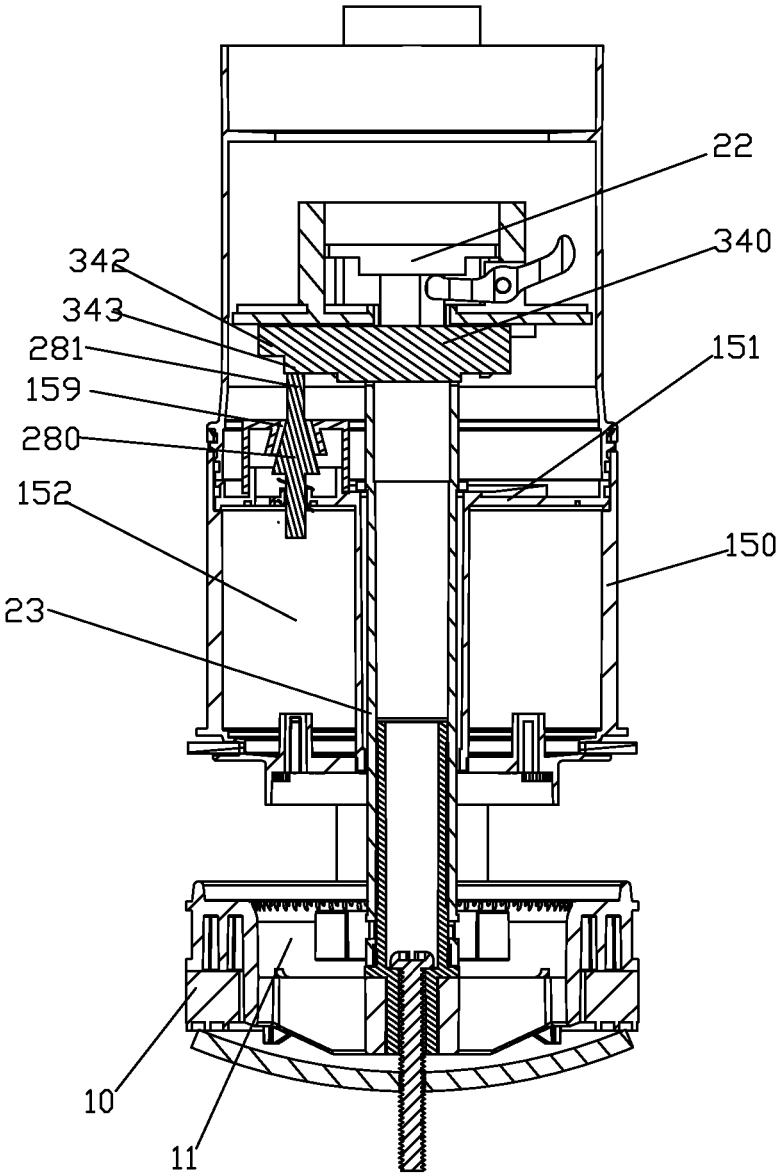
FIG. 26 illustrates a schematic diagram of another preferred structure of the third embodiment in the second drainage volume.

In other case, as a preferred substitution of this embodiment, as figured in FIG. 25 and FIG. 26, the separating plate 151 is just disposed with an third exhaust hole 159 connecting the float chamber 152 and the outer air, when operating the first starting switch, the third exhaust hole 159 is open smaller to form the smaller flowing passage, water enters the float chamber 152 to exhaust the air in the float chamber 152 out of the smaller flowing passage so as to drain the first drainage volume of water, when operating the second starting switch, the third exhaust hole 159 is open larger to form the larger flowing passage, water enters the float chamber 152 to exhaust the air in the float chamber 152 out of the larger flowing passage so as to drain the second drainage volume of water, when operating the first starting switch, the switch element makes the control element control the third exhaust hole 159 to open smaller, when operating the second starting switch, the switch element makes the control element control the third exhaust hole 159 to open larger. The first starting switch comprises a first button 21 and the second starting switch respectively comprises a second button 22, the switch element is a slide block 340, the slide block 340 is disposed with a first pressing block 341 and a second pressing block 342, the control element is a controllable valve 280, the controllable valve 280 is disposed with a pressed block 281, pressing the first button 21, the first pressing block 341 of the slide block 340 abuts against the pressed block 281 of the controllable valve 280 to make the controllable valve 280 open smaller so as to make the flowing passage be smaller; pressing the second button 22, the second pressing block 342 of the slide block 340 abuts against the pressed block 281 of the controllable valve 280 to make the controllable valve 280 open larger so as to make the flowing passage be larger, thus realizing the first drainage volume and the second drainage volume of the drain valve to achieve the object of the present invention, the working principle is similar to above mentioned, here is not further described.

The Fourth Embodiment

Figure 27:
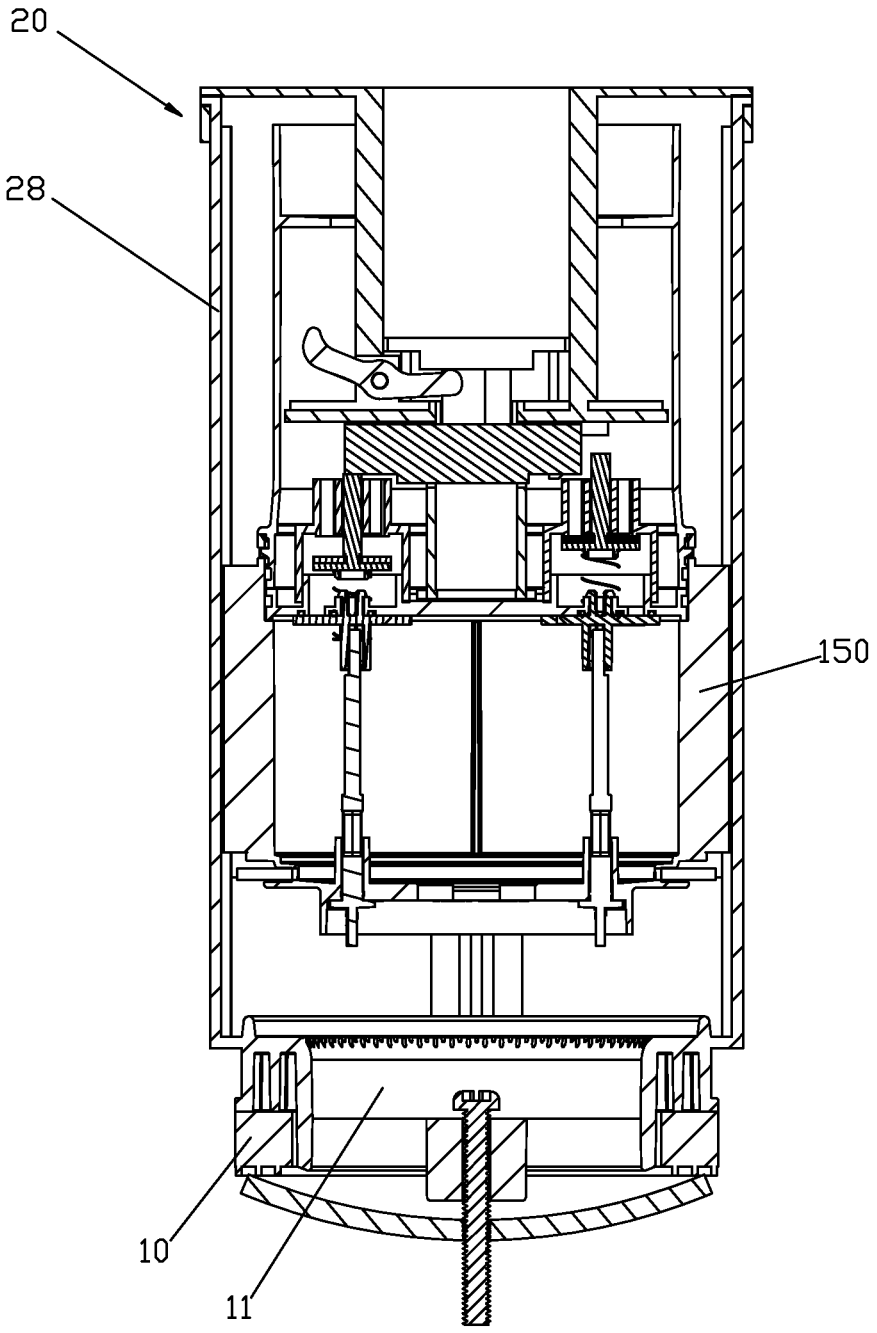
FIG. 27 illustrates a sectional diagram of a double flow control mechanism of a soft touch drain valve of a fourth embodiment of the present invention.

Referring to FIG. 27, this embodiment differs from above mentioned embodiments in that:

In this embodiment, the valve body 20 is not disposed a guiding rod 23 but a housing 28, the housing 28 is fixedly assembled to the base 10, the hollow float 110, 150 are sleeved inside the housing 28 to move forth and back along the housing 28 vertically.

The switch element of all embodiments of the present invention can be applied with the slide block structure of the first embodiment, the pendulum block structure of the second embodiment or other existing switch structure of the field, it can be alternatively chosen as needed.

The first button and the second button of the present invention are button type starting switch, obviously, other type of the starting switch existing in the field are available, such as a wrench type starting switch, it can be alternatively chosen as needed.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

What is claimed is:

1. A double flow control mechanism of a soft touch drain valve, comprising a base, a float component and a starting component, the base is assembled with a valve body, the base is disposed with a drainage opening (11), the float component can move relative to the base to open and close the drainage opening, wherein;

the starting component comprises a first starting switch and a second starting switch, the float component is movably assembled to the valve body and connected to the starting component in driving way, the float component is disposed with a flowing passage, the flowing passage connects the inner side and the outer side of a float chamber of the float component, the starting component controls the size of the flowing passage;

operating the first starting switch can drive the float component to rise up, the starting component opens a smaller flowing passage, the resultant force of the float component is influenced by the smaller flowing passage so as to drain a first drainage volume of water;

operating the second starting switch can drive the float component to rise up, the starting component opens a larger flowing passage, the resultant force of the float component is influenced by the larger flowing passage so as to drain a second drainage volume of water.

2. The double flow control mechanism of a soft touch drain valve according to claim 1, wherein the starting component comprises a switch element and a control element, the switch element is connected to the first starting switch and the second starting switch in driving way, the switch element is coupled to the control element in driving way, the control element is coupled to the flow passage, operating the first starting switch or the second starting switch can drive the control element by the switch element to control the size of the flowing passage or the on-off of the flowing passage.

3. The double flow control mechanism of a soft touch drain valve according to claim 2, wherein the first starting switch comprises a first button and the second starting switch comprises a second button, the first button and the second button are movably assembled to the valve body (20), the switch element is a slide block, the slide block is laterally slidably assembled to the valve body and connects to the first button and the second button in driving way, the slide block is disposed with a pressing block, the control element is disposed with a pressed block, the pressing block separates from the pressed block or abuts against the pressed block to implement the driving fit between the switch element and the control element.

4. The double flow control mechanism of a soft touch drain valve according to claim 2, wherein the first starting switch comprises a first button and the second starting switch comprises a second button, the first button and the second button are movably assembled to the valve body, the switch element is a pendulum rod rotatably connected to the valve body, the pendulum rod has a first pendulum block and a second pendulum block, the first pendulum block is coupled to the button in driving way, the second pendulum block separates from the control element or abuts against the control element to implement the driving fit between the switch element and the control element.

5. The double flow control mechanism of a soft touch drain valve according to claim 1, wherein the float component comprises a float and a bottom plate connected to the bottom portion of the float, the float chamber is formed between the bottom plate and the float, the bottom plate is disposed with an inlet hole connecting the float chamber and the drainage opening, operating the first starting switch can open the inlet hole smaller to form the smaller flowing passage, water enters the float through the smaller flowing passage to drain a first drainage volume of water, operating the second starting switch can open the inlet hole larger to form the larger flowing passage, water enters the float through the larger flowing passage to drain a second drainage volume of water.

6. The double flow control mechanism of a soft touch drain valve according to claim 1, wherein the float component comprises a float and a bottom plate connected to the bottom portion of the float, the float chamber is formed between the bottom plate and the float, the bottom plate is disposed with a first inlet hole and a second inlet hole that can connect the float chamber and the drainage opening, the first inlet hole forms the smaller flowing passage, the second inlet hole forms the larger flowing passage, or in another case, the first inlet hole and the second inlet hole jointly form the larger flowing passage, when operating the first starting switch, water enters the float through the smaller flowing passage formed by the first inlet hole to drain a first drainage volume of water, when operating the second starting switch, water enters the float through the larger flowing passage formed by the second inlet hole or the larger flowing passage formed jointly by the first and the second inlet hole to drain a second drainage volume of water.

7. The double flow control mechanism of a soft touch drain valve according to claim 2, wherein the float component comprises a float and a bottom plate connected to the bottom portion of the float, the float chamber is formed between the bottom plate and the float, the bottom plate is disposed with a first inlet hole and a second inlet hole that can connect the float chamber and the drainage opening, the first inlet hole forms the smaller flowing passage, the second inlet hole forms the larger flowing passage, or in another case, the first inlet hole and the second inlet hole jointly form the larger flowing passage, when operating the first starting switch, water enters the float through the smaller flowing passage formed by the first inlet hole to drain a first drainage volume of water, when operating the second starting switch, water enters the float through the larger flowing passage formed by the second inlet hole or the larger flowing passage formed jointly by the first and the second inlet hole to drain a second drainage volume of water.

8. The double flow control mechanism of a soft touch drain valve according to claim 7, wherein the control element comprises a first check valve assembled to the first inlet hole and a second check valve assembled to the second inlet hole, when the switch element separates from the second check valve, the switch element abuts against the first check valve to open the first inlet hole and close the second inlet hole, when the switch element separates from the first check valve, the switch element abuts against the second check valve to open the second inlet hole and close the first inlet hole.

9. The double flow control mechanism of a soft touch drain valve according to claim 7, wherein the control element is assembled inside the float, the control element comprises a control board, the control board is disposed with a first transition hole that can be connected to the first inlet hole, when the switch element separates from the control element, the control board is contacted with the bottom plate so as to close the second inlet hole, and the first inlet hole is connected to the first transition hole to keep the first inlet hole (121) in open state, when the switch element abuts against the control element, the control board separates from the bottom plate so as to open the second inlet hole.

10. The double flow control mechanism of a soft touch drain valve according to claim 6, wherein a first adjusting piece and a second adjusting piece are further disposed and rotatable relative to the bottom plate, the first adjusting piece is disposed with a first adjusting hole used to adjust the size of the first inlet hole, the second adjusting piece is disposed with a second adjusting hole used to adjust the size of the second inlet hole.

11. The double flow control mechanism of a soft touch drain valve according to claim 1, wherein the float component comprises a float and a separating plate assembled inside the float, the float chamber is formed between the float and the separating plate, the float chamber is connected to the drainage opening, the separating plate is disposed with an exhaust pipe/hole connecting the float and the outer air, when operating the first starting switch, the exhaust pipe/hole is open smaller to form the smaller flowing passage, water enters the float chamber to exhaust the air in the float chamber out of the smaller flowing passage so as to drain a first drainage volume of water, when operating the second starting switch, the exhaust pipe/hole is open larger to form the larger flowing passage, water enters the float chamber to exhaust the air in the float chamber out of the larger flowing passage so as to drain a second drainage volume of water.

12. The double flow control mechanism of a soft touch drain valve according to claim 1, wherein the float component comprises a float and a separating plate assembled inside the float, the float chamber is formed between the float and the separating plate, the float chamber is connected to the drainage opening, the separating plate is disposed with a first exhaust pipe/hole and a second exhaust pipe/hole connecting the float and the outer air, the first exhaust pipe/hole forms the smaller flowing passage, the second exhaust pipe/hole forms the larger flowing passage, or in another case, the first exhaust pipe/hole and the second exhaust pipe/hole jointly form the larger flowing passage, when operating the first starting switch, water enters the float chamber to exhaust the air in the float chamber out of the smaller flowing passage formed by the first exhaust pipe/hole so as to drain a first drainage volume of water, when operating the second starting switch, water enters the float chamber to exhaust the air in the float chamber out of the larger flowing passage formed by the second exhaust pipe/hole or the larger flowing passage formed jointly by the first and the second exhaust pipe/hole so as to drain a second drainage volume of water.

13. The double flow control mechanism of a soft touch drain valve according to claim 2, wherein the float component comprises a float and a separating plate assembled inside the float, the float chamber is formed between the float and the separating plate, the float chamber is connected to the drainage opening, the separating plate is disposed with a first exhaust pipe/hole and a second exhaust pipe/hole connecting the float and the outer air, the first exhaust pipe/hole forms the smaller flowing passage, the second exhaust pipe/hole forms the larger flowing passage, or in another case, the first exhaust pipe/hole and the second exhaust pipe/hole jointly form the larger flowing passage, when operating the first starting switch, water enters the float chamber to exhaust the air in the float chamber out of the smaller flowing passage formed by the first exhaust pipe/hole so as to drain a first drainage volume of water, when operating the second starting switch, water enters the float chamber to exhaust the air in the float chamber out of the larger flowing passage formed by the second exhaust pipe/hole or the larger flowing passage formed jointly by the first and the second exhaust pipe/hole so as to drain a second drainage volume of water.

14. The double flow control mechanism of a soft touch drain valve according to claim 13, wherein the control element comprises a first check valve assembled to the first exhaust pipe/hole and a second check valve assembled to the second exhaust pipe/hole, when the switch element separates from the second check valve, the switch element abuts against the first check valve to open the first exhaust pipe/hole and close the second exhaust pipe/hole, when the switch element separates from the first check valve, the switch element abuts against the second check valve to open the second exhaust pipe/hole and close the first exhaust pipe/hole.

15. The double flow control mechanism of a soft touch drain valve according to claim 13, wherein the first exhaust pipe forms the smaller flowing passage, the first exhaust pipe and the second exhaust pipe jointly form the larger flowing passage, the control element is assembled to a third check valve assembled inside the second exhaust pipe, the first exhaust pipe keeps open, when the switch element separates from the control element, the third check valve closes the second exhaust pipe, when the switch element abuts against the control element, the third check valve opens the second exhaust pipe.

16. The double flow control mechanism of a soft touch drain valve according to claim 12, wherein the first exhaust pipe and the second exhaust pipe are vertically movably assembled to the separating plate to adjust the height of the bottom end of the first exhaust pipe and the second exhaust pipe in the float chamber;

or in other case, the first exhaust pipe and the second exhaust pipe are fixedly assembled to the separating plate, a first adjusting sleeve pipe and a second adjusting sleeve pipe are further configured that the first adjusting sleeve pipe is movably sleeved on the lower portion of the first exhaust pipe to adjust the height of the bottom end of the first adjusting sleeve pipe in the float chamber and the second adjusting sleeve pipe is movably sleeved on the lower portion of the second exhaust pipe to adjust the height of the bottom end of the second adjusting sleeve pipe in the float chamber.

17. The double flow control mechanism of a soft touch drain valve according to claim 13, wherein the first exhaust hole forms the smaller flowing passage, the first exhaust hole and the second exhaust hole jointly form the larger flowing passage, the control element is movable assembled inside the float chamber, the control element comprises a control board, the control board is disposed with a second transition hole connected to the first exhaust hole, when the switch element separates from the control element, the control board is contacted with the separating plate to close the second exhaust hole and the first exhaust hole is connected to the second transition hole to keep the first exhaust hole in open state, when the switch element abuts against the control element, the control board separates from the separating plate to open the second exhaust hole.

18. The double flow control mechanism of a soft touch drain valve according to claim 12, claim 13, claim 14 or claim 17, wherein a first adjusting rod and second adjusting rod are movably assembled to the float component, the top end of the first adjusting rod is disposed with a first adjusting portion, the top end of the second adjusting rod is disposed with a second adjusting portion, the first adjusting portion can adjust the size of the first exhaust hole, the second adjusting portion can adjust the size of the second exhaust hole.

19. The double flow control mechanism of a soft touch drain valve according to claim 1, wherein the float component comprises a hollow float extending along the longitudinal axis, the hollow float is sleeved on the valve body to move forth and back vertically along the valve body.

20. The double flow control mechanism of a soft touch drain valve according to claim 19, wherein the valve body is disposed with a guiding rod, the guiding rod is fixedly assembled to the base, the hollow float is sleeved on the outer side of the guiding bar to move forth and back vertically along the guiding rod.

21. The double flow control mechanism of a soft touch drain valve according to claim 19, wherein the valve body is disposed with a housing, the housing is fixedly assembled to the base, the hollow float is sleeved inside the housing to move forth and back vertically along the housing.

22. The double flow control mechanism of a soft touch drain valve according to claim 1, wherein the starting component further comprises at least a lift rod, the lift rod is movably assembled to the valve body and is connected to the float component in driving way, operating the first starting switch or the second starting switch can make the lift rod swing to life the float component to drain water.

23. A double flow control method of a soft touch drain valve, wherein when operating a first starting switch, a starting component drives a float component to rise up to leave from a drainage opening of a base so as to drain water, at the same time, the starting component opens a smaller flowing passage in the float component, the resultant force of the float component is influenced by the smaller flowing passage so as to drain a first drainage volume of water;

operating a second starting switch can drive the float component to rise up to leave from the drainage opening of the base so as to drain water, at the same time, the starting component opens a larger flowing passage in the float component, the resultant force of the float component is influenced by the larger flowing passage so as to drain a second drainage volume of water.

24. The double flow control mechanism of a soft touch drain valve according to claim 7, wherein a first adjusting piece and a second adjusting piece are further disposed and rotatable relative to the bottom plate, the first adjusting piece is disposed with a first adjusting hole used to adjust the size of the first inlet hole, the second adjusting piece is disposed with a second adjusting hole used to adjust the size of the second inlet hole.

25. The double flow control mechanism of a soft touch drain valve according to claim 13, wherein the first exhaust pipe and the second exhaust pipe are vertically movably assembled to the separating plate to adjust the height of the bottom end of the first exhaust pipe and the second exhaust pipe in the float chamber;

or in other case, the first exhaust pipe and the second exhaust pipe are fixedly assembled to the separating plate, a first adjusting sleeve pipe and a second adjusting sleeve pipe are further configured that the first adjusting sleeve pipe is movably sleeved on the lower portion of the first exhaust pipe to adjust the height of the bottom end of the first adjusting sleeve pipe in the float chamber and the second adjusting sleeve pipe is movably sleeved on the lower portion of the second exhaust pipe to adjust the height of the bottom end of the second adjusting sleeve pipe in the float chamber.

26. The double flow control mechanism of a soft touch drain valve according to claim 14, wherein the first exhaust pipe and the second exhaust pipe are vertically movably assembled to the separating plate to adjust the height of the bottom end of the first exhaust pipe and the second exhaust pipe in the float chamber;

or in other case, the first exhaust pipe and the second exhaust pipe are fixedly assembled to the separating plate, a first adjusting sleeve pipe and a second adjusting sleeve pipe are further configured that the first adjusting sleeve pipe is movably sleeved on the lower portion of the first exhaust pipe to adjust the height of the bottom end of the first adjusting sleeve pipe in the float chamber and the second adjusting sleeve pipe is movably sleeved on the lower portion of the second exhaust pipe to adjust the height of the bottom end of the second adjusting sleeve pipe in the float chamber.

27. The double flow control mechanism of a soft touch drain valve according to claim 15, wherein the first exhaust pipe and the second exhaust pipe are vertically movably assembled to the separating plate to adjust the height of the bottom end of the first exhaust pipe and the second exhaust pipe in the float chamber;

or in other case, the first exhaust pipe and the second exhaust pipe are fixedly assembled to the separating plate, a first adjusting sleeve pipe and a second adjusting sleeve pipe are further configured that the first adjusting sleeve pipe is movably sleeved on the lower portion of the first exhaust pipe to adjust the height of the bottom end of the first adjusting sleeve pipe in the float chamber and the second adjusting sleeve pipe is movably sleeved on the lower portion of the second exhaust pipe to adjust the height of the bottom end of the second adjusting sleeve pipe in the float chamber.

28. The double flow control mechanism of a soft touch drain valve according to claim 13, wherein a first adjusting rod and second adjusting rod are movably assembled to the float component, the top end of the first adjusting rod is disposed with a first adjusting portion, the top end of the second adjusting rod is disposed with a second adjusting portion, the first adjusting portion can adjust the size of the first exhaust hole, the second adjusting portion can adjust the size of the second exhaust hole.

29. The double flow control mechanism of a soft touch drain valve according to claim 14, wherein a first adjusting rod and second adjusting rod are movably assembled to the float component, the top end of the first adjusting rod is disposed with a first adjusting portion, the top end of the second adjusting rod is disposed with a second adjusting portion, the first adjusting portion can adjust the size of the first exhaust hole, the second adjusting portion can adjust the size of the second exhaust hole.

30. The double flow control mechanism of a soft touch drain valve according to claim 17, wherein a first adjusting rod and second adjusting rod are movably assembled to the float component, the top end of the first adjusting rod is disposed with a first adjusting portion, the top end of the second adjusting rod is disposed with a second adjusting portion, the first adjusting portion can adjust the size of the first exhaust hole, the second adjusting portion can adjust the size of the second exhaust hole.

* * * * *